US008646424B2

(12) United States Patent
Fujiyoshi et al.

(10) Patent No.: US 8,646,424 B2
(45) Date of Patent: Feb. 11, 2014

(54) VARIABLE VALVE TIMING DEVICE

(75) Inventors: Toshiki Fujiyoshi, Okazaki (JP); Akihiko Takenaka, Anjo (JP)

(73) Assignee: Denso Corporation, Kariya (JP)

( * ) Notice: Subject to any disclaimer, the term of this patent is extended or adjusted under 35 U.S.C. 154(b) by 243 days.

(21) Appl. No.: 13/309,897

(22) Filed: Dec. 2, 2011

(65) Prior Publication Data

US 2012/0186547 A1 Jul. 26, 2012

(30) Foreign Application Priority Data

Jan. 20, 2011 (JP) ..... 2011-10097

(51) Int. Cl.
*F01L 1/34* (2006.01)

(52) U.S. Cl.
USPC ..... 123/90.17

(58) Field of Classification Search
USPC ..... 123/90.12, 90.15, 90.17, 90.33, 90.34; 464/160, 161; 137/625.25, 625.26
See application file for complete search history.

(56) References Cited

U.S. PATENT DOCUMENTS 3,482,600 A * 12/1969 Hodgson ..... 137/596.2
4,037,410 A * 7/1977 Jackson et al. ..... 60/445
5,205,249 A * 4/1993 Markley et al. ..... 123/90.17
5,207,192 A * 5/1993 Smith ..... 123/90.17
5,361,735 A * 11/1994 Butterfield et al. ..... 123/90.17
2010/0175651 A1 7/2010 Takenaka
2011/0162601 A1 7/2011 Fujiyoshi et al.

FOREIGN PATENT DOCUMENTS

JP 10-184937 7/1998
JP 2003-097739 4/2003
JP 2008-063950 3/2008
JP 2009-138537 6/2009

OTHER PUBLICATIONS

Office Action (3 pages) dated Feb. 19, 2013, issued in corresponding Japanese Application No. 2011-010097 and English translation (3 pages).

* cited by examiner

*Primary Examiner* — Thomas Denion
*Assistant Examiner* — Daniel Bernstein
(74) *Attorney, Agent, or Firm* — Nixon & Vanderhye PC

(57) ABSTRACT

A variable valve timing device includes a control valve for switching fluid communication among ports. The control valve includes a sleeve, a spool, a movable member, and resilient members. A first resilient member pushes the spool in both of the regions. A second resilient member acts on the spool via the movable member engaged with the spool in an advancing region. In a lock region, the movable member rests on the sleeve to enable the spool to move freely from the second resilient member. As a result, force acting on the spool can be restricted in the lock region. The movable member is supported from a radial inside by the spool and is radially distanced from the sleeve. As a result, it is possible to reduce a sliding resistance acting on the movable member.

12 Claims, 20 Drawing Sheets

VARIABLE VALVE TIMING DEVICE

CROSS REFERENCE TO RELATED APPLICATION

This application is based on Japanese Patent Application No. 2011-10097 filed on Jan. 20, 2011, the contents of which are incorporated herein by reference in its entirety.

FIELD OF THE INVENTION

The present invention relates to a variable valve timing device for adjusting a valve timing of a valve, which is opened and closed by a camshaft driven by a torque transmitted from a crankshaft of the internal combustion engine.

BACKGROUND OF THE INVENTION

Conventionally, several kinds of variable valve timing devices (VVT) are known in this field. For example, a vane type VVT has a housing and a vane rotor relatively rotatable to the housing. The housing is adapted to be rotated with one of a crankshaft and a cam shaft. The vane rotor is housed in the housing and is adapted to be rotated with the other one of the crankshaft and the cam shaft. JP2010-163942A discloses a device that varies a relative rotational phase of the vane rotor with respect to the housing in an advancing direction or a retarding direction. The device varies a phase difference by controlling fluid flow, e.g., by introducing operational fluid into an advancing chamber or a retarding chamber both defined within the housing by dividing a housing chamber by the vane rotor. The VVT may include a control valve having a sleeve and a spool which is slidably supported and housed in the sleeve in a reciprocal manner. The control valve switches and controls introducing flow and discharging flow to the advancing chamber and the retarding chamber in accordance with an axial position of the spool.

The axial position of the spool is controlled in accordance with a balance between an axial driving force and an axial biasing force. The driving force is generated by a driving source in response to an instruction value. The biasing force urges the spool in an opposite direction to the driving force, and is adjusted by a device which provides bias adjusting means, i.e., bias setting means. The bias adjusting means varies the biasing force in a step like manner at a boundary position between two regions. The regions correspond to a movable range of the spool and are defined adjacent to each other in an axial direction. By generating such a step like characteristic on the biasing force by the bias adjusting means, the control valve demonstrates required performance. For this purpose, the control valve may include a movable member and a pair of resilient members. The movable member and the resilient members may be housed in the sleeve.

In the first region, the movable member engages with the spool with respect to the axial direction, and moves with the spool. On the other hand, in the second region, the movable member abuts and rests on the sleeve with respect to the axial direction, and enables a relative movement of the spool. The first resilient member generates a first restoring force that axially urges the spool in both the first region and the second region. The second resilient member generates a second restoring force that axially urges the movable member in both the first region and the second region. By employing such arrangement, since the spool engaged with the movable member by the second restoring force is urged in the axial direction in the first region, a summed force of the second restoring force and the first restoring force acts as a biasing force against the driving force. On the other hand, in the second region, since a movable member is abut on the sleeve and an urging of the spool by the second restoring force is restricted, only the first restoring force acts as the biasing force against the driving force. Accordingly, the urging force may be changed in a step like manner. This is caused by switching acting force at a boundary position between the first and the second region. The acting force is switched between the summed force of the second restoring force and the first restoring force, and a single force of the first restoring force.

SUMMARY OF THE INVENTION

According to the bias adjusting means disclosed in 3P2010-163942A, the cylindrical movable member is supported from a radial outside by the sleeve, and is kept apart from the spool in a radial outside direction. Therefore, in the second region where the movable member rests on the sleeve, since the spool can move relative to the movable member without contacting the movable member in a radial direction, the spool receives only a small movement resistance. As shown in FIG. 21, which shows a relationship between a spool position and the instruction value to the driving source, in the second region, there may be a small amount of hysteresis between a movement in an axial forward direction Dg and a movement in an axial reverse direction Dr. Contrary, in the first region where the movable member and the spool are axially engaged to move together, the spool receives a sliding resistance which the movable member generates by coming in contact with the sleeve in the radial direction and sliding on the sleeve. At this movement, the movable member moves while receiving the second restoring force from the second resilient member. Therefore, if an acting direction of the second restoring force inclines to the axial direction of the sleeve, the movable member may receive a side force in the radial direction and be easily pushed onto the sleeve located on the radial outside. Such force pushing the movable member onto the sleeve may be generated therebetween and increases the sliding resistance which increases a movement resistance of the spool. As a result, in the first region, the sliding resistance may act on the spool in both moving directions. As shown in FIG. 21, in the first region, there may be a large amount of hysteresis between a movement in an axial forward direction Dg and a movement in an axial reverse direction Dr. As a result, the large hysteresis adversely affects the response characteristic of the control valve. In another aspect, the sliding resistance between the movable member and the sleeve may be changed irregularly as the spool moves. This causes the spool to move intermittently. In other words, a stick-slip phenomenon on the spool movement may be easily occurred. As a result, the irregularly changing sliding resistance adversely affects the response characteristic of the control valve.

It is an object of the present invention to provide a variable valve timing device having a control valve with a stable response characteristic.

It is another object of the present invention to provide a variable valve timing device having a control valve which can suppress a variation in the response characteristic.

According to the present invention, a variable valve timing device (VVT) is provided. The VVT adjusts a valve timing of a valve being opened/closed by a camshaft which is driven by a torque transmitted from a crankshaft of an internal combustion engine. The VVT comprises a housing defining a hydraulic chamber therein. The VVT comprises a vane rotor disposed to define an advancing chamber and a retarding chamber by dividing the hydraulic chamber in a rotational direction, the vane rotor being rotatable to change a rotational phase relative to the housing in response to hydraulic fluid introduced into one of the advancing chamber and the retarding chamber. The VVT comprises a control valve having a sleeve and a spool disposed in the sleeve in a reciprocally movable manner, the control valve being adapted to control in-flow and out-flow of the hydraulic fluid with respect to both the advancing chamber and the retarding chamber by adjusting a spool position in an axial direction. The WT comprises a driving source which changes the spool position by generating a driving force of the spool in response to an instruction value. The VVT comprises a biasing device which generates and adjusts a biasing force biasing the spool against the driving force. The control valve provides a first region and a second region arranged along the axial direction in a region where the spool is movable. The biasing device includes a movable member which is capable of being engaged with the spool in the first region to move together with the spool, and is capable of resting on the sleeve in the second region to enable the spool to move relative to the movable member. The biasing device includes a first resilient member which generates a first restoring force for pushing the spool in the axial direction when the spool is in both the first region and the second region. The biasing device includes a second resilient member which generates a second restoring force for pushing the movable member in the axial direction when the spool is in both the first region and the second region. The movable member engages with the spool in the first region to enable the second restoring force to act on the spool. The movable member rests on the sleeve in the second region to disable the second restoring force to act on the spool. The movable member is supported by the spool in a manner that the movable member is apart from the sleeve in a radial direction.

Accordingly, the biasing force may be changed in a step like manner. This is caused by switching acting force at a boundary position between the first and the second region. The acting force is switched between the summed force of the second restoring force and the first restoring force, and a single force of the first restoring force. Therefore, it is possible to provide required characteristics in the first and second regions respectively.

The movable member is apart from the sleeve in a radial direction. Therefore, the spool can move with a small resistance in the first region in which the spool and the movable member are engaged. As a result, it is possible to reduce a hysteresis between a forward movement and a reverse movement. In the second region, the spool may move in a sliding manner on the movable member that rests on the sleeve. However, the movable member can be held stable on the sleeve. Therefore, it is possible to reduce a side force that could push the movable member onto the spool. As a result, it is possible to reduce sliding resistance acting on the spool in the second region, and to reduce a hysteresis between a forward movement and a reverse movement. In addition, since a fluctuation of friction between the spool and the movable member is reduced to a sufficiently low level, it is possible to suppress a stick-slip in the second region. As a result, it is possible to provide the variable valve timing device having the control valve with a stable response characteristic.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Hereafter, a plurality of embodiments of the present invention are described. In the following description for embodiments, repetitive description may be omitted by using the same reference symbols for indicating the same or corresponding parts and components. In a case that only a part of structure of embodiment is described, the preceding description for the corresponding parts in the preceding embodiments may be referenced to understand such part that is not described in detail. It is possible to combine any components in different embodiments selectively, if such combination is clearly described. In addition, even if such combinations are not clearly described, it is possible to combine any components in different embodiments selectively unless no trouble arise in such combinations.

(First Embodiment)

Figure 1:
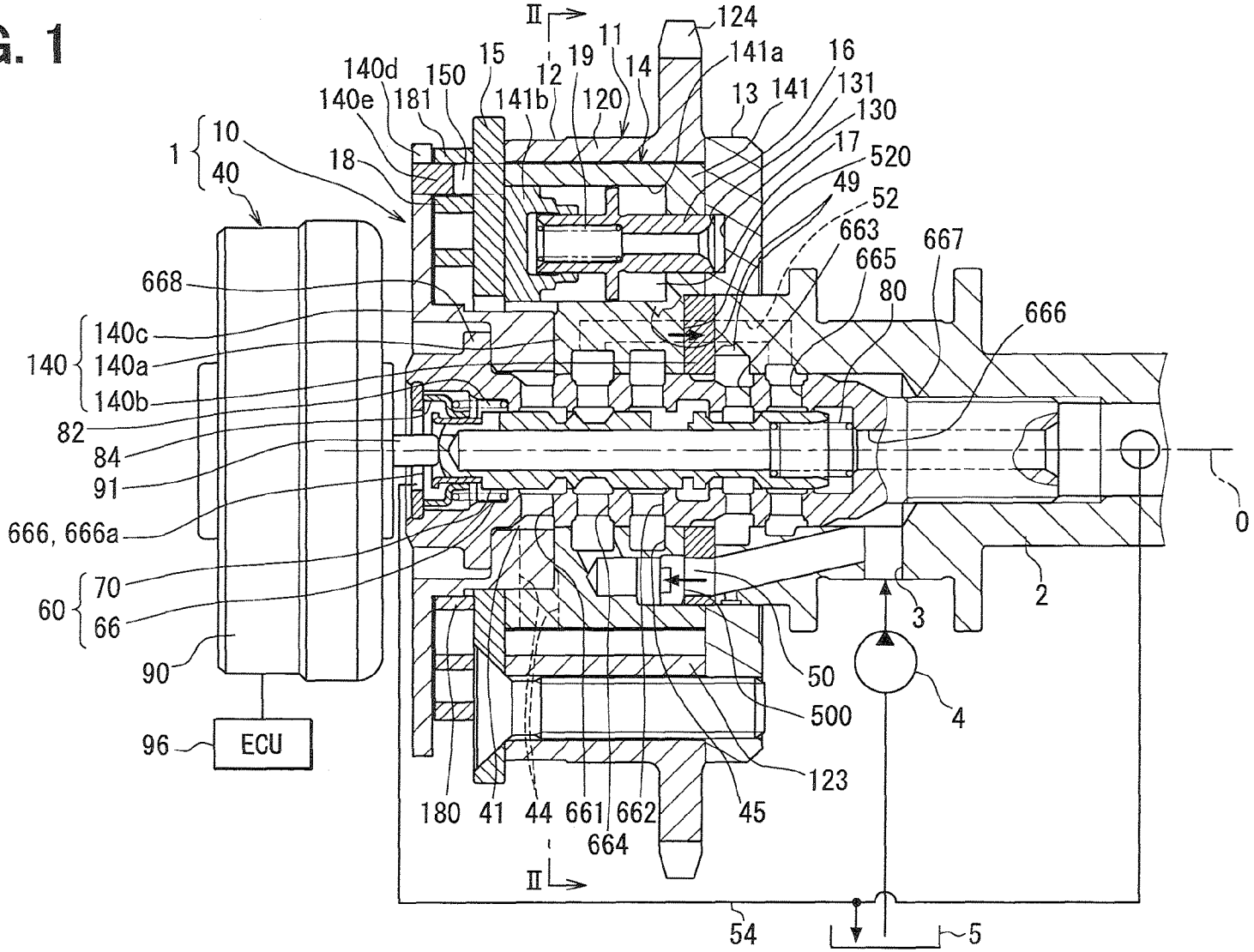
FIG. 1 is a cross sectional view, on a I-I cross section in FIG. 2, of a variable valve timing device according to a first embodiment of the present invention.

FIG. 1 shows a first embodiment in which a variable valve timing device 1 is applied to an internal combustion engine for a vehicle. The variable valve timing device 1 is a fluid driven type which uses oil as hydraulic fluid, and adjusts valve timing of an inlet valve assumed as a valve.

(Basic Components)

Figure 2:
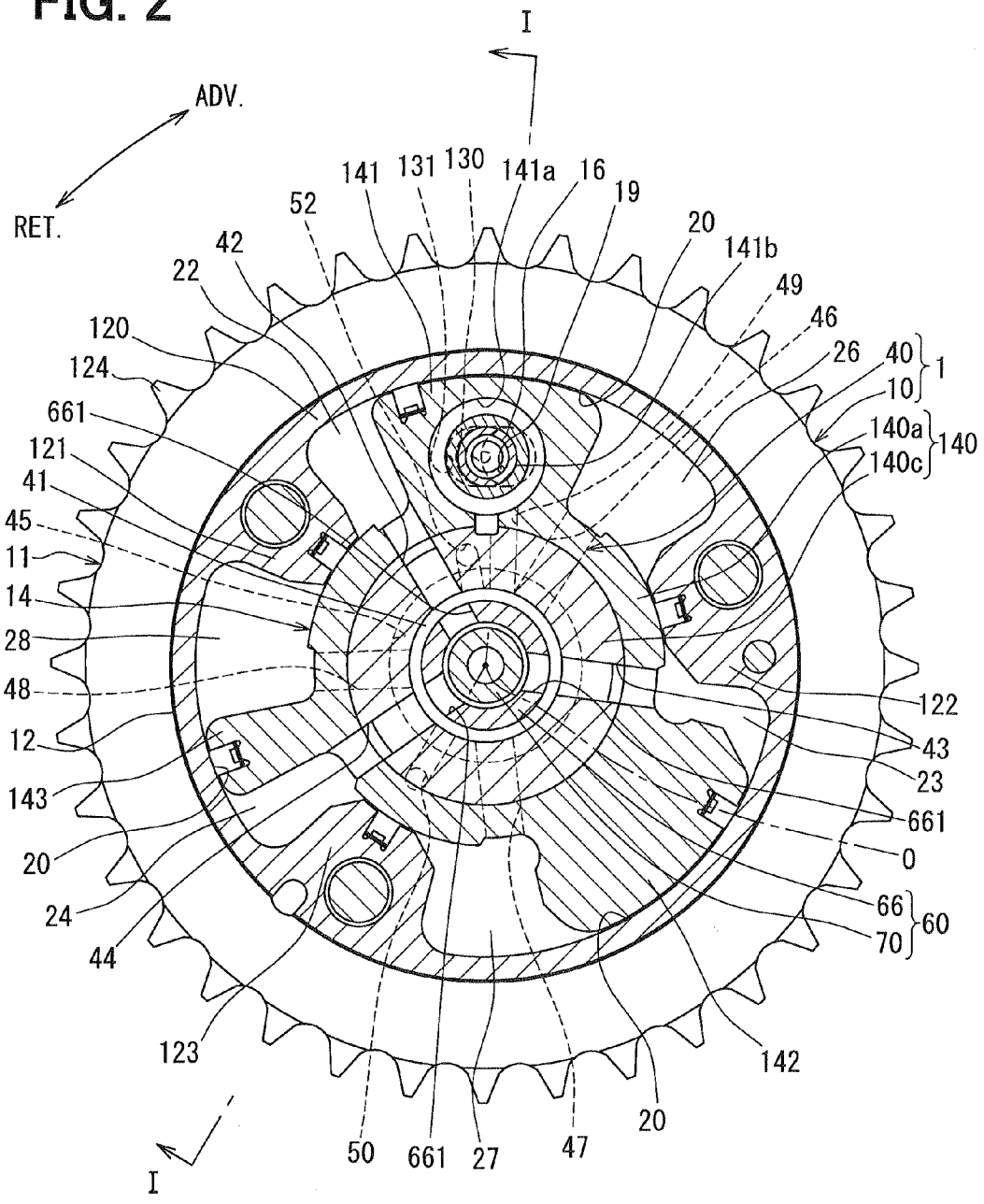
FIG. 2 is a cross sectional view showing a II-II cross section in FIG. 1.

First, the basic components of the variable valve timing device 1 are explained. As shown in FIGS. 1 and 2, the variable valve timing device 1 includes a rotary-mechanism part 10 and a control part 40. The rotary-mechanism part 10 is disposed in a transmission system which transmits an engine torque outputted from a crankshaft (not shown) to the cam shaft 2 in the internal combustion engine. The control part 40 controls in-flow and out-flow of the hydraulic oil for driving the rotary-mechanism part 10.

(Rotary Mechanism Part)

In the rotary-mechanism part 10, the housing 11 is formed by placing and tightening a rear plate 13 and a front plate 15 on both axial end of the shoe casing 12. The housing 11 defines a hydraulic chamber therein. The housing 11 is adapted to rotate synchronously with the crankshaft. A shoe casing 12, i.e., a housing, includes a housing body 120 provided as a cylindrical-main part, a plurality of shoes 121, 122, 123 provided as partition portions, and a sprocket 124. The shoes 121, 122, 123 are circumferentially arranged one after another at predetermined intervals on an inner surface of the housing body 120 and radially inwardly projects therefrom. Chambers 20 are formed between circumferentially adjacent pair of the shoes 121, 122, 123, respectively. The sprocket 124 is connected with the crankshaft via a timing chain (not shown). During rotation of the internal combustion engine, since the engine torque is transmitted from the crankshaft to the sprocket 124 via the connection, the housing 11 is interlocked with the crankshaft and rotates in the predetermined direction (the clockwise direction in FIG. 2.)

A vane rotor 14 is disposed in the hydraulic chamber defined in the housing 11. The vane rotor 14 has a rotational axis that is supported coaxial with a rotational axis of the housing 11. The vane rotor 14 and the housing 11 are arranged on the same axis. The vane rotor 14 is arranged in the housing 11 so that both side surfaces of the vane rotor 14 are slidably in contact with the rear plate 13 and the front plate 15. The vane rotor is adapted to rotate synchronously with the cam shaft 2. The vane rotor 14 includes a shaft 140 provided as a cylindrical rotatable part, and a plurality of vanes 141, 142, 143 provided as partition portions. The shaft 140 is secured on the cam shaft 2 in a coaxial manner. Thereby, the vane rotor 14 is rotatable with the cam shaft 2 in a direction, i.e., clockwise direction shown in FIG. 2, in which the housing 11 is also rotatable. The vane rotor 14 is relatively rotatable to the housing 11 within a predetermined relative rotatable range. In the present embodiment, the shaft 140 includes a shaft body 140*a*, a boss 140*b* on one end of the shaft body 140*a* and a bush 140*c* on the other end of the shaft body 140*a*. The boss 140*b* axially penetrates the rear plate 13 and is connected to the camshaft 12. The bush 140*c* axially penetrates the front plate 15 and provides an inner cavity which opens toward outside of the housing 11.

The vanes 141, 142, 143 are arranged on the shaft body 140*a* and protrude in a radial outside direction from the shaft body 140*a*. The vanes 141, 142, 143 protrude from outer portions which are distanced predetermined intervals each other. Each of the vanes 141, 142, 143 is placed in a corresponding one of the chambers 20. The vane rotor 14 is rotatable to change a rotational phase relative to the housing 11 in response to hydraulic fluid introduced into one of the advancing chambers 22, 23, 24 and the retarding chambers 26, 27, 28. The vane rotor 14 is disposed to define advancing chambers 22, 23, 24 and retarding chambers 26, 27, 28 by dividing the hydraulic chamber 20 in a rotational direction. In detail, each of the vanes 141, 142, 143 divides the corresponding chamber 20 in the rotational direction. As a result, the vanes 141, 142, 143 define the advancing chambers 22, 23, 24 and retarding chambers 26, 27, 28 which introduce or discharge the hydraulic fluid. An advancing chamber 22 is defined between the shoe 121 and the vane 141. An advancing chamber 23 is defined between the shoe 122 and the vane 142. An advancing chamber 24 is defined between the shoe 123 and the vane 143. A pair of the advancing chamber and the retarding chamber is defined on both rotational sides of the vane. A retarding chamber 26 is formed between the shoe 122 and the vane 141. A retarding chamber 27 is formed between the shoe 123 and the vane 142. A retarding chamber 28 is defined between the shoe 121 and the vane 143.

The vane 141 accommodates a lock member 16 which can be engaged with a lock hole 130 formed on the rear plate 13 to lock rotational phase of the vane rotor 14 to the housing 11. In order to drive the lock member 16, the vane 141 defines a lock release chamber 17 in which the hydraulic oil is introduced to unlock the phase by disengaging the lock member 16 from the lock hole 130.

The rotary-mechanism 10 varies the valve timing by varying the phase difference between the housing 11 and the vane rotor 14 when the lock pin 32 is disengaged from the lock hole 31. The rotary-mechanism 10 varies the phase in an advancing direction, and advances the valve timing by introducing the hydraulic oil into the advancing chambers 22, 23, 24 and discharging the hydraulic oil from the retarding chambers 26, 27, 28. The rotary-mechanism 10 varies the phase in a retarding direction, and retards the valve timing by discharging the hydraulic oil from the advancing chambers 22, 23, 24 and introducing the hydraulic oil into the retarding chambers 26, 27, 28.

In this embodiment, a regulated phase region is defined as a region that is preferable for starting the internal combustion engine. The regulated phase region is set a part of a variable range which can be realized by the rotary-mechanism part 10. The regulated phase region extends from a predetermined middle phase between the most retarded phase and the most advanced phase to the most advanced phase. In addition, a lock phase is defined within the regulated phase region. In the lock phase the rotary-mechanism part 10 is locked by the lock member 16. The lock phase is set as a middle phase in the regulated phase region, and is defined as an optimal phase for starting the internal combustion engine. According to such arrangement, it is possible to ease starting up of the internal combustion engine by suppressing excessive decrease of an intake air amount caused by a delayed closure of the intake valve at the start up of the internal combustion engine.

(Control Part)

A main-advance passage 41 is formed along an inner periphery of the shaft 140. Branch advance passages 42, 43, 44 penetrate the shaft 140. The branch advance passages 42, 43, 44 are fluidly communicated with corresponding advancing chambers 22, 23, 24 respectively and are also communicated with the main-advance passage 45 commonly. A main-retard passage 45 is formed by a groove opening on an inner periphery of the shaft 140. Branch retard passages 46, 47, 48 penetrate the shaft 140. The branch retard passages 46, 47, 48 are fluidly communicated with corresponding retarding chambers 26, 27, 28 respectively and also communicated with the main-retard passage 45 commonly. A lock release passage 49 penetrates the shaft 140 and is fluidly communicate with the lock release chamber 17.

A main-supply passage 50 penetrates the shaft 140 and is fluidly communicated with a pump 4 through a feed passage 3 formed in the cam shaft 2. The pump 4 is a supply source of the hydraulic oil. The pump 4 is a mechanical pump driven by the internal combustion engine through the crank shaft. While the engine is operated, the pump 4 pumps up the hydraulic oil from a drain pan 5 and continuously discharges the hydraulic oil to the feed passage 3. The feed passage 3 always communicates with a discharge port of the pump 4 without respect to the rotation of the cam shaft 2. Thus, while the engine is operated, the hydraulic oil discharged from the pump 4 is continuously supplied to the main-supply passage 50.

Figure 4:
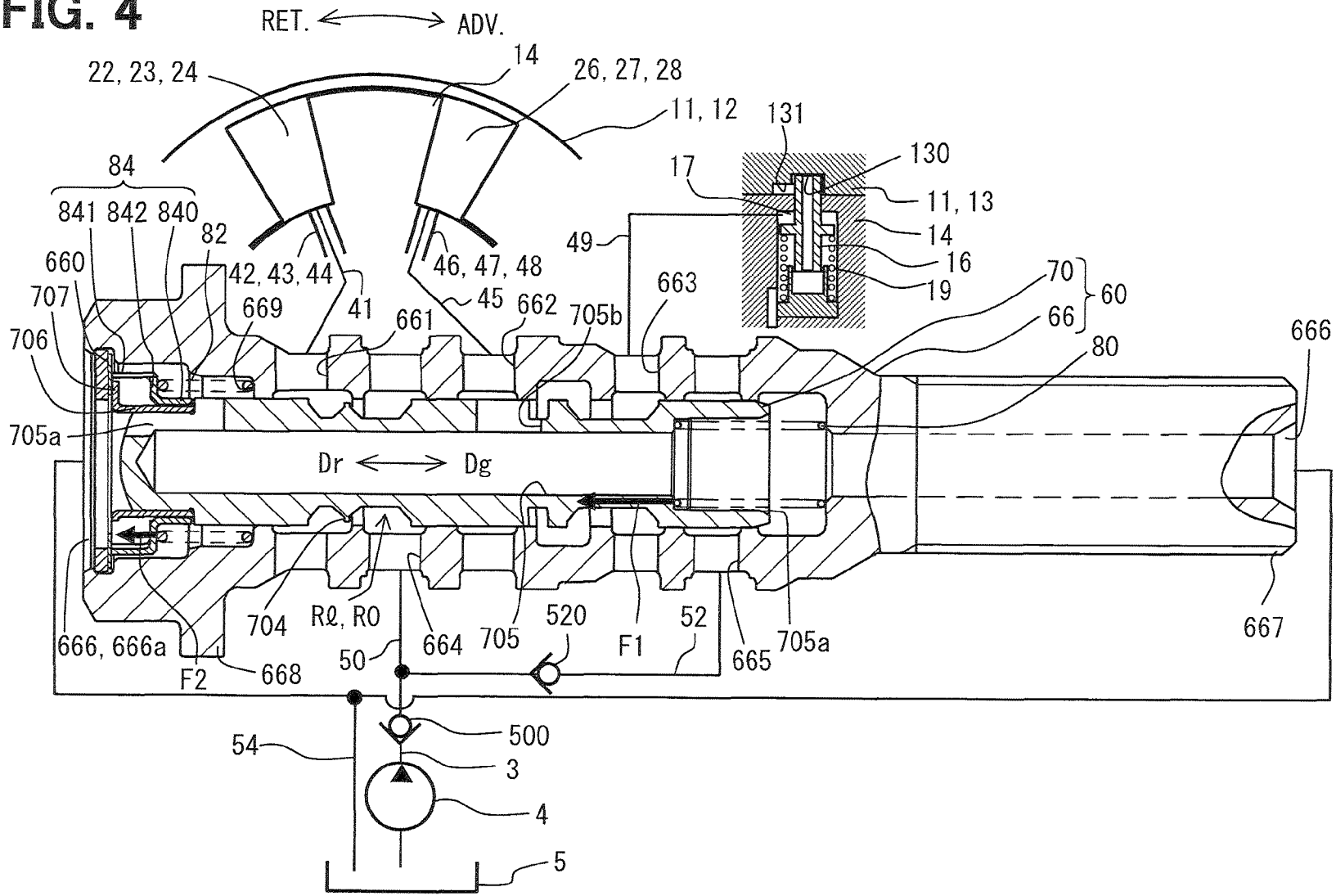
FIG. 4 is a cross sectional view showing a control valve in the variable valve timing device in FIG. 1.

A sub-supply passage 52 penetrates the shaft 140, and is branched from the main-supply passage 50. The sub-supply passage 52 receives the hydraulic oil supplied from the pump 4 through the main-supply passage 50. As shown in FIG. 4, a main-check valve, e.g., lead valve, 500 is disposed in the main-supply passage 50 between a branch portion to the sub-supply passage 52 and the pump 4. A sub-check valve 520 is disposed in the sub-supply passage 52. The main-check valve 500 prevents the hydraulic oil from flowing backwards to the pump 4 side in the main-supply passage 50. The sub-check valve 520 prevents the hydraulic oil from flowing backwards to the main-supply passage 50 side in the sub-supply passage 52.

A drain recovering passage 54 is disposed on outside components from the rotary-mechanism part 10 and the cam shaft 2. The drain recovering passage 54 is formed to discharge the hydraulic oil to the drain pan 5, and is opened to atmospheric air with the drain pan 5 as a drain recovering components.

The variable valve timing device includes a control valve 60. The control valve 60 has a sleeve 66 and a spool 70 disposed in the sleeve 66 in a reciprocally movable manner. The control valve 60 is adapted to control in-flow and out-flow of the hydraulic fluid with respect to both the advancing chambers and the retarding chambers by adjusting a spool position in an axial direction to switch communication among ports.

The control valve 60 is a spool type valve in which the spool 70 disposed in the sleeve 66 is driven in a reciprocal manner in an axial direction. The spool 70 is driven to change a spool position by using restoring forces obtained by the resilient members 80 and 82 and driving force generated by the driving source 90 in response to an electric power supplied to the driving source 90. The control valve 60 provides an advancing port 661, a retarding port 662, a lock release port 663, a main-supply port 664, a sub-supply port 665, and a drain port 666. The advancing port 661 is formed to communicate with an advance-main passage 41. The retarding port 662 is formed to communicate with a retard-main passage 45. The lock release port 663 is formed to communicate with a lock release passage 49. The main-supply port 664 is formed to communicate with a main-supply passage 50. The sub-supply port 665 is formed to communicate with a sub-supply passage 52. A pair of drain ports 666 is formed to communicate with a drain recovering passage 54. The control valve 60 changes communicating state among the ports 661, 662, 663, 664, 665, 666 according to a spool position that is variable by driving the spool 70.

The control circuit 96 may be provided by an electric circuit which includes main components such as a micro computer. The control circuit 96 is electrically connected with the driving source 90 and other electrical components for the internal combustion engine. The control circuit 96 performs controls for the internal combustion engine. The control circuit 96 at least performs a current control for the driving source 90 based on computer program stored in an internal memory.

(Torque on Vane Rotor)

Figure 3:
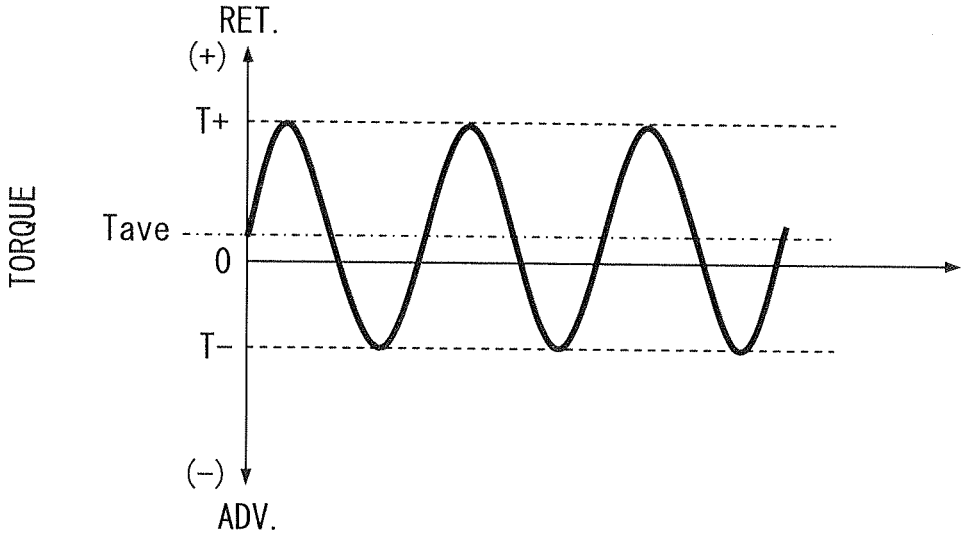
FIG. 3 is a characteristic diagram for explaining torque acting on the variable valve timing device in FIG. 1.

Next, a fluctuation torque which acts on the vane rotor 14 from the cam shaft 2 is explained. During rotation of the internal combustion engine, the cam shaft 2 drives the valve, e.g., the intake valve, and receives the fluctuation torque caused by a spring reaction force from a spring on the valve, etc. The fluctuation torque also acts on the vane rotor 14 of the rotary-mechanism part 10 through the cam shaft 2. As shown in FIG. 3, the fluctuation torque changes in an alternating manner between a negative torque acting in the advancing direction to the housing 11 and the positive torque acting in the retarding direction to the housing 11. In this embodiment, due to causes such as a friction between the cam shaft 2 and bearings, a positive peak torque "T+" is larger than a negative peak torque "T−", and an average torque "Tave" is shifted to the positive torque side. Therefore, the vane rotor 14 is biased to the retarding direction to the housing 11 by the fluctuation torque transmitted from the cam shaft 2 during rotation of the internal combustion engine.

(Vane Rotor Components)

Next, components which drive the vane rotor 14 toward a lock phase are explained. Referring to FIG. 1, in the rotary-mechanism part 10, a first engage pin 150 is disposed in a front plate 15 of the housing 11. The first engage pin 150 is formed in a columnar shape and is protruded from the front plate 15 toward an outside of the housing 11. The first engage pin 150 is disposed in parallel to a rotation center line "O" of the rotary-mechanism part 10 and on an eccentric location from the rotation center line "O". An arm portion 140*d* and a second engage pin 140*e* are disposed on a bush 140*c* which is formed on the shaft 140 and protrudes from the front plate 15 toward an outside of the housing 11. The arm portion 140*d* is formed in a substantially plate shape which extends in parallel to the front plate 15. The second engage pin 140*e* is formed in a columnar shape and is protruded from the arm portion 140*d* to the front plate 15. The second engage pin 140*e* is disposed in parallel to the rotation center line "O" and on an eccentric location from the rotation center line "O". The first engage pin 150 is disposed to provide a first eccentric distance from the rotation center line "O". The second engage pin 140*e* is disposed to provide a second eccentric distance from the rotation center line "O". The pins 150 and 140*e* are arranged to make the first and second eccentric distance substantially equal. The second engage pin 140*e* is disposed to be placed out of a rotation locus of the first engage pin 150 in the axial direction of the rotary-mechanism part 10.

An assist spring 18 made of metal is arranged around the bush 140*c*. The assist spring 18 is a spiral spring which is manufactured by winding a material piece on a substantially flat plane. The assist spring 18 is disposed between the front plate 15 and the arm portion 140*d* in a manner that a winding center is placed on the rotation center line "O". An inner end of the assist spring 18 forms a wound part 180 by winding itself on an outer periphery of the bush 140*c*. An outer end of the assist spring 18 forms an engage part 181 by bending itself in a U shaped portion. The engage part 181 is formed and placed to be able to engage with either one of the first engage pin 150 and the second engage pin 140*e* according to a rotation phase.

When the rotation phase is adjusted in a range in a retard side from the lock phase, the engage part 181 of the assist spring 18 engages with the first engage pin 150 on the housing 11. At this time, the second engage pin 140*e* on the vane rotor 14 is apart from the engage part 181. Therefore, the vane rotor 14 is pushed toward the lock phase in an advancing direction by receiving a restoring force generated by the assist spring 18. In this embodiment, the restoring force of the assist spring 18 biasing the vane rotor 14 in the advancing direction is set larger than an average value of a fluctuation torque that is shifted to the retarding direction.

On the other hand, when the rotation phase is adjusted in a range in an advance side from the lock phase, the engage part 181 of the assist spring 18 engages with the second engage pin 140*e* on the vane rotor 14. At this time, the first engage pin 150 on the housing 11 is apart from the engage part 181. Therefore, the biasing on the vane rotor 14 by the assist spring 18 is restricted.

(Lock Components)

Next, components which lock the rotation phase are explained. As shown in FIGS. 1, 2, and 4, the rear plate 13 has a regulated hole 131 and a lock hole 130. The regulated hole 131 may be referred to as a restriction hole 131 to restrict a variable range. The regulated hole 131 is formed in a groove shape with a closed bottom and is extended along the rotating direction and is terminated on both ends. The lock hole 130 is formed in a circular hole with a closed bottom and opens on the bottom of the regulated hole 131 at an advanced side end.

In the vane rotor 14, the vane 141 has a receiving hole 141*a* in which a cylindrical lock member 16 is accommodated in parallel to a rotational center line "O" of the rotary-mechanism part 10. The receiving hole 141*a* is placed to face the regulated hole 131 in the axial direction in the regulated phase region, and to face the lock hole 130 in the axial direction in the lock phase.

A lock spring 19 made of a metal compression coil spring is coaxially accommodated in the receiving hole 141*a* in a coaxial manner with the lock member 16. The lock spring 19 is deformed by compressing it by disposing it between a retainer 141*b* fixed on the vane 141 and the lock member 16. Thereby, the lock spring 19 generates a restoring force which pushes and biases the lock member 16 toward a side to the rear plate 13. The receiving hole 141*a* forms a lock release chamber 17 which is located on a side of the lock member 16 opposite to the lock spring 19 to push the lock member 16 against the lock spring 19. The lock member 16 is movable in the receiving hole 141*a*. The lock member 16 moves toward the rear plate 13 when the lock spring 19 prevails pressure acting on the lock member 16 from the hydraulic oil introduced into the lock release chamber 17. The lock member 16 moves to be apart from the rear plate 13 when pressure of the hydraulic oil exceeds the biasing force of the lock spring 19.

When the lock member 16 is disengaged from both the regulated hole 131 and the lock hole 130, the rotary-mechanism 10 can vary the valve timing for maximum range. If hydraulic oil is discharged from the lock release chamber 17, when the lock member 16 has disengaged from both the regulated hole 131 and the lock hole 130, the lock member 16 moves toward the rear plate 13 side, and first inserted into the regulated hole 131. When the lock member 16 is engaged with the regulated hole 131 alone, the rotary-mechanism 10 can vary the valve timing for regulated range that is smaller than the maximum range. Then, if the phase is changed by receiving forces such as a fluctuation torque and a restoring force of the assist spring 18 and reaches to the lock phase, the lock member 16 further moves toward the rear plate 13 and is inserted into the lock hole 130 to be firmly engaged with the lock hole 130. As a result, since the phase can be locked at the lock phase, it is possible to restrict changing of the valve timing in the lock phase.

When the lock member 16 is engaged with the lock hole 130 through the regulated hole 131, the rotary-mechanism 10 can not vary the valve timing. If hydraulic oil is introduced into the lock release chamber 17, when the lock member 16 has engaged with the lock hole 130, the lock member 16 moves in a direction opposite to the rear plate 13, and is pulled out from the lock hole 130 and the regulated hole 131. As a result, since the lock for phase is released, it is possible to change the valve timing freely within the maximum range.

(Detail of Control Valve)

Next, the detailed structure of the control valve 60 is explained. FIG. 1 shows a control valve 60. Since the cam shaft 2 and the vane rotor 14 are engaged to rotate together, those members provide rotary components 2, 14. A sleeve 66 is made of metal in a cylindrical shape, and is disposed inside the rotary components 2, 14 in a coaxial manner with the rotary components 2, 14. The sleeve 66 includes a securing portion 667 and a flange portion 668. The securing portion 667 is formed on one end of the sleeve 66 and is formed with a male thread which can be screwed on the cam shaft 2. The flange portion 668 is firmed on the other end of the sleeve 66 and is formed in a circular flange shape. The flange portion 668 and the cam shaft 2 clamps the shaft 140 of the vane rotor 14. As shown in FIG. 4, the sleeve 66 provides a plurality of ports for in-flow and out-flow of the hydraulic oil. The sleeve 66 has the following ports in an order from an axial end on the flange portion 668 side to an axial end on the securing portion 667 side: one of the drain port 666; the advancing port 661; the main-supply port 664; the retarding port 662; the lock release port 663; the sub-supply port 665; and the other one of the drain port 666.

The spool 70 is made of metal and is formed in a cylindrical shape. The spool 70 is coaxially disposed in the sleeve 66 in a manner that the spool 70 is slidingly supported on an inner surface of the sleeve 66 so that the spool 70 is movable in a reciprocal manner in the axial forward direction Dg and the axial reverse direction Dr. The axial forward direction Dg corresponds to a direction in which the spool 70 moves toward the securing portion 667. The axial reverse direction Dr corresponds to a direction in which the spool 70 moves toward the flange portion 668. The spool 70 includes a restrictor portion 704 which restricts a flow amount of the hydraulic oil between the advancing port 661 and the main-supply port 664 at a predetermined position. As shown in FIG. 4, the restrictor portion 704 restricts a flow amount of the hydraulic oil by forming a radial gap between circumferential surfaces. One of circumferential surfaces is provided by an inner surface of the sleeve 66. The other one of circumferential surface is provided by an outer surface of the restrictor portion 704 which is formed smaller in diameter than the inner surface of the sleeve 66. Alternatively, although it is not illustrated, the restrictor portion 704 may restrict a flow amount of the hydraulic oil mainly by a length of passage. In this case, the inner surface of the sleeve 66 and the outer surface of the restrictor portion 704 may be formed to slide each other to make the radial gap narrow, but are formed to shorten an axial length of the radial gap.

The spool 70 has a communication passage 705 formed in a cylindrical hole which extends through a radial center in the axial direction. The communication passage 705 provides primary openings 705*a* on both axial ends of the spool 70. Therefore, the communication passage 705 is always fluidly communicated with both the drain ports 666 irrespective of the spool position. Furthermore, the spool 70 has a secondary opening 705*b* on an axial middle part of the spool 70. The opening 705*b* is communicated with the communication passage 705. The opening 705*b* is disposed to be communicated with at least one of the retarding port 662 and the lock port 663 according to the axial position of the spool 70.

Figure 5:
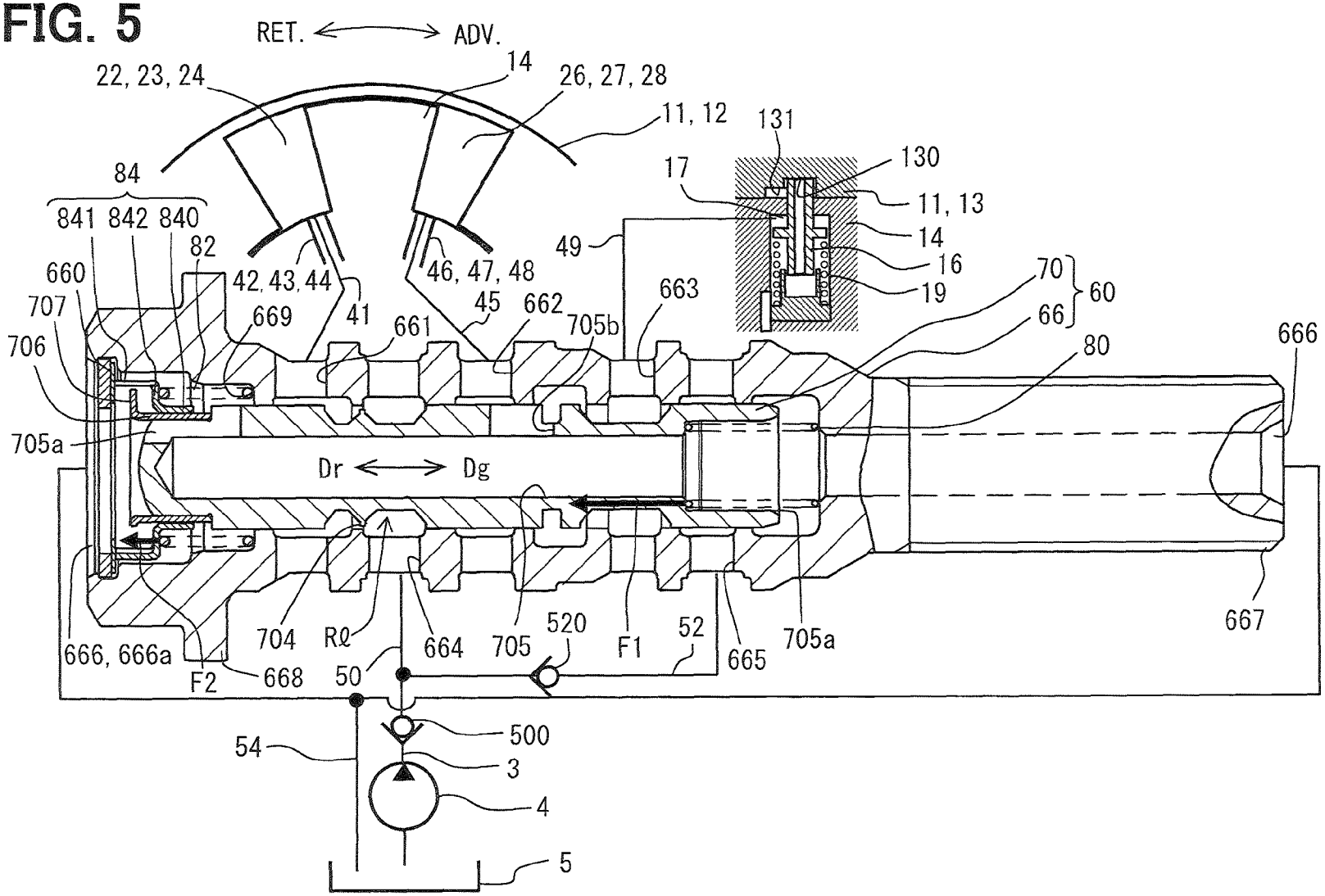
FIG. 5 is a cross sectional view showing one operational position of the control valve in FIG. 4.
Figure 10A:
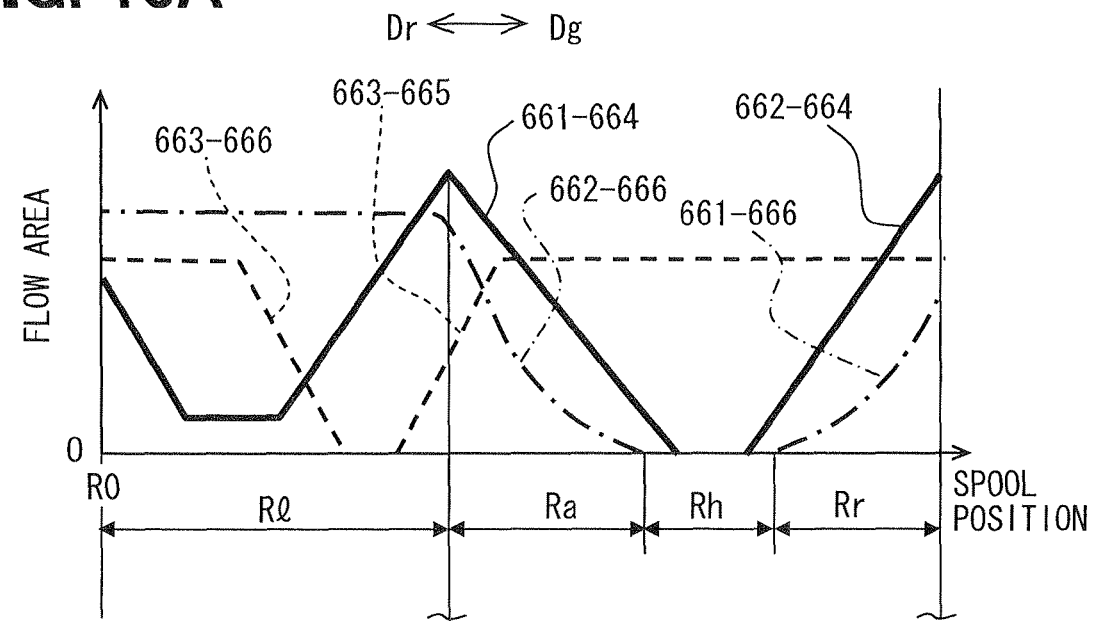
FIG. 10A is a characteristics diagram of the control valve in FIG. 4.

FIG. 10A shows changing characteristics of flow areas between the ports provided on the control valve. When the spool 70 moves to the lock region Rl shown in FIG. 10A, the advancing port 661 is connected with the main-supply port 664 as shown in FIGS. 4 and 5. The hydraulic oil supplied from the pump 4 to the passages 3, 50 is introduced into the advancing chambers 22, 23, 24 through the ports 664, 661 and the passage 41, 42, 43, 44. At this time, introducing amount of the hydraulic oil to the advancing chambers 22, 23, 24 may be restricted by the restrictor portion 704. When the spool 70 moves to the lock region Rl, the retarding port 662 is connected with the drain ports 666 through the passage 705. The hydraulic oil in the retarding chambers 26, 27, 28 is discharged to the drain pan 5 disposed on a downstream side to the passage 54 through the passages 46, 47, 48, 45 and the ports 662, 666. When the spool 70 moves to the lock region Rl, the lock release port 663 is connected with the drain ports 666 through the passage 705. The hydraulic oil in the lock release chamber 17 is discharged to the drain pan 5 through the passage 49 and the ports 663, 666.

Figure 6:
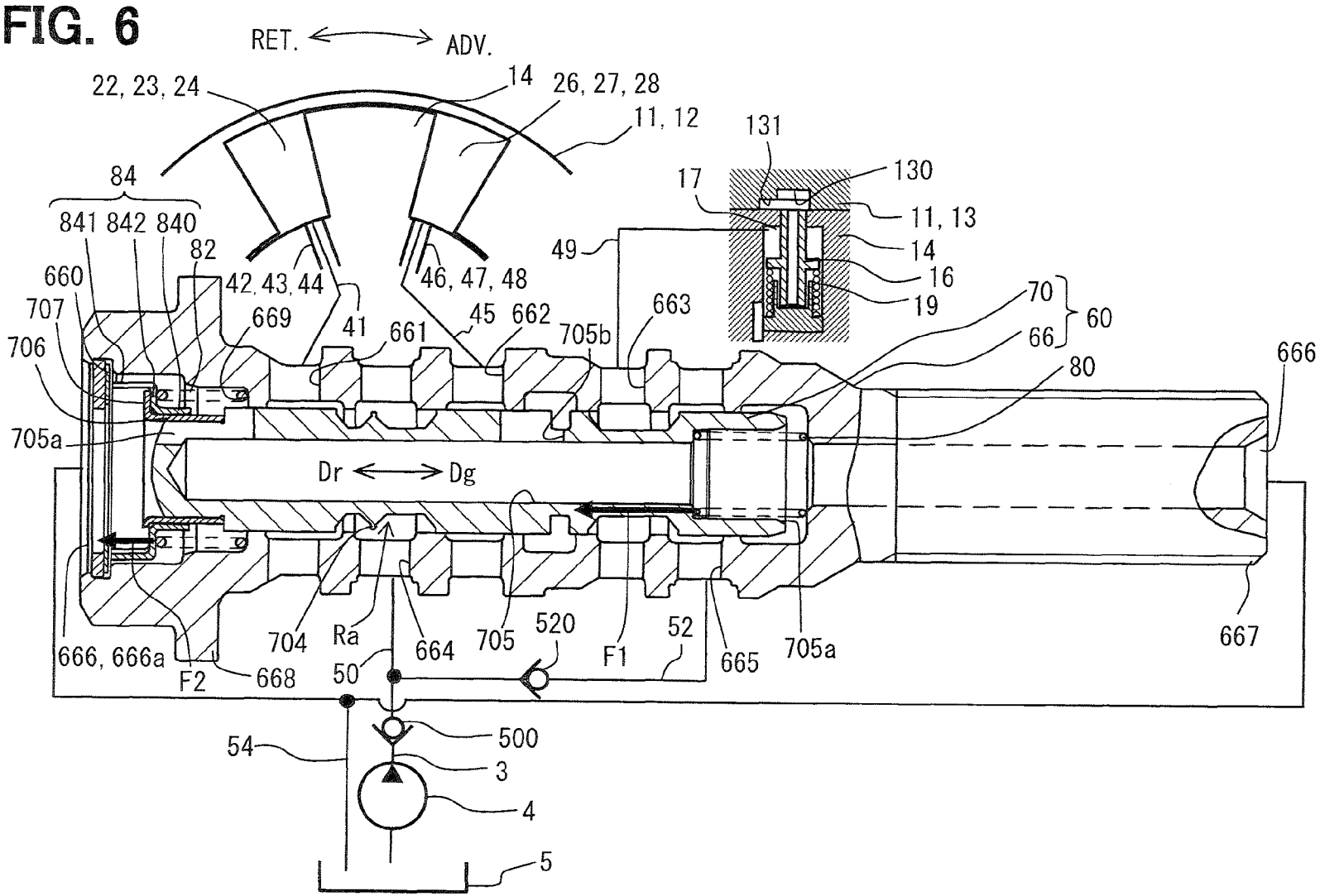
FIG. 6 is a cross sectional view showing one operational position of the control valve in FIG. 4.

The lock region Rl and the advancing region Ra are defined adjacent to each other without any overlap and gap. The advancing region Ra is on the axial forward side to the lock region Rl. When the spool 70 moves to the advancing region Ra shown in FIG. 10A, the advancing port 661 is connected with the main-supply port 664 as shown in FIG. 6. The hydraulic oil supplied from the pump 4 to the passages 3, 50 is introduced into the advancing chambers 22, 23, 24 through the ports 664, 661 and the passage 41, 42, 43, 44. When the spool 70 moves to the advancing region Ra, the retarding port 662 is connected with the drain ports 666 through the passage 705. The hydraulic oil in the retarding chambers 26, 27, 28 is discharged to the drain pan 5 through the passages 46, 47, 48, 45 and the ports 662, 666. When the spool 70 moves to the advancing region Ra, the lock release port 663 is connected with the sub-supply port 665. The hydraulic oil supplied from the pump 4 to the passages 3, 50, 52 is introduced into the lock release chamber 17 through the ports 665, 663 and the passage 49.

Figure 7:
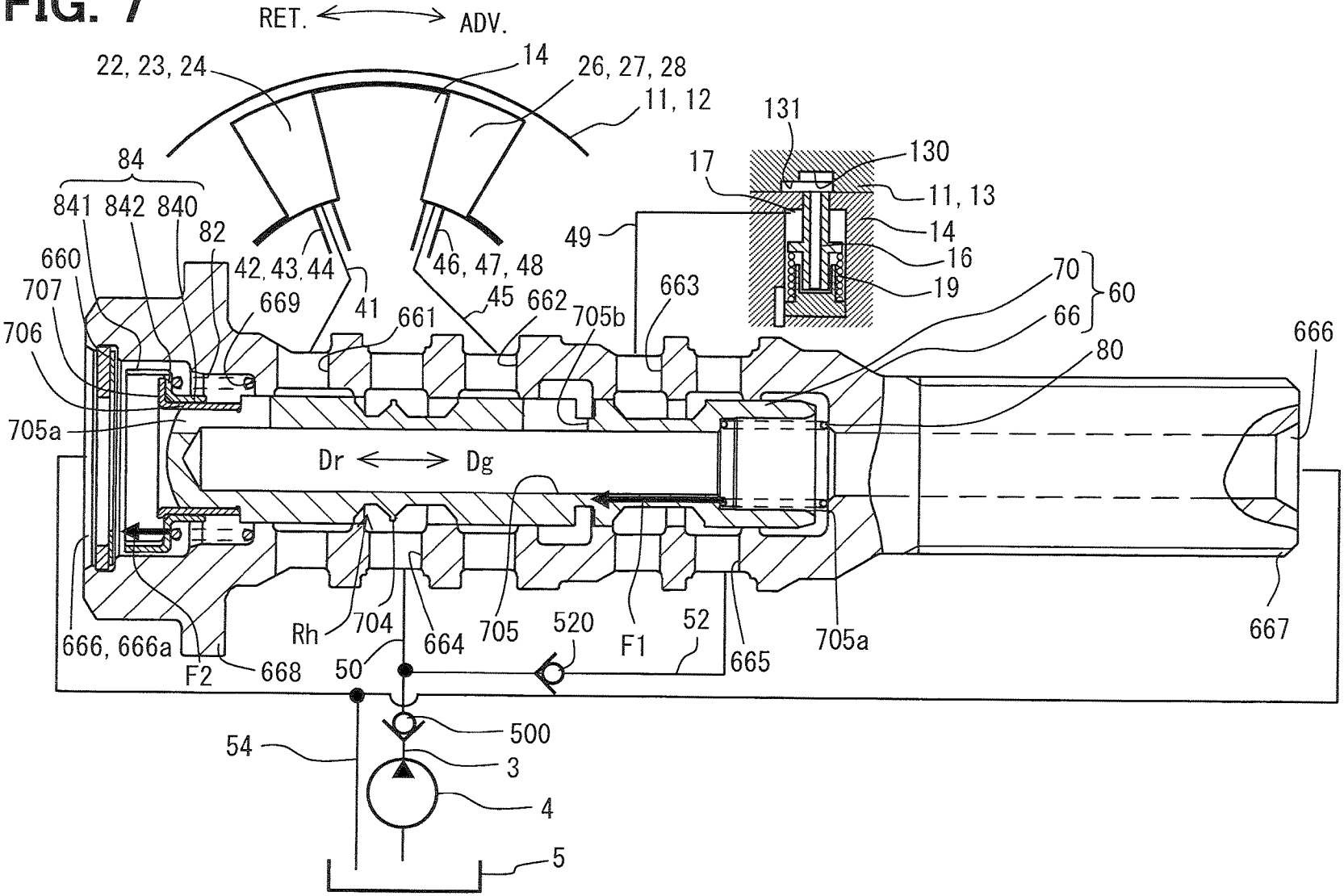
FIG. 7 is a cross sectional view showing one operational position of the control valve in FIG. 4.

The holding region Rh and the advancing region Ra are defined adjacent to each other without any overlap and gap. The holding region Rh is on the axial forward direction Dg to the advancing region Ra. When the spool 70 moves to the holding region Rh shown in FIG. 10A, both the advancing port 661 and the retarding port 662 are disconnected from any other ports as shown in FIG. 7. The hydraulic oil is kept in the advancing chambers 22, 23, 24 and the retarding chambers 26, 27, 28. When the spool 70 moves to the holding region Rh, the lock release port 663 is connected with the sub-supply port 665. The hydraulic oil supplied from the pump 4 to the passages 3, 50, 52 is introduced into the lock release chamber 17 through the ports 665, 663 and the passage 49.

Figure 8:
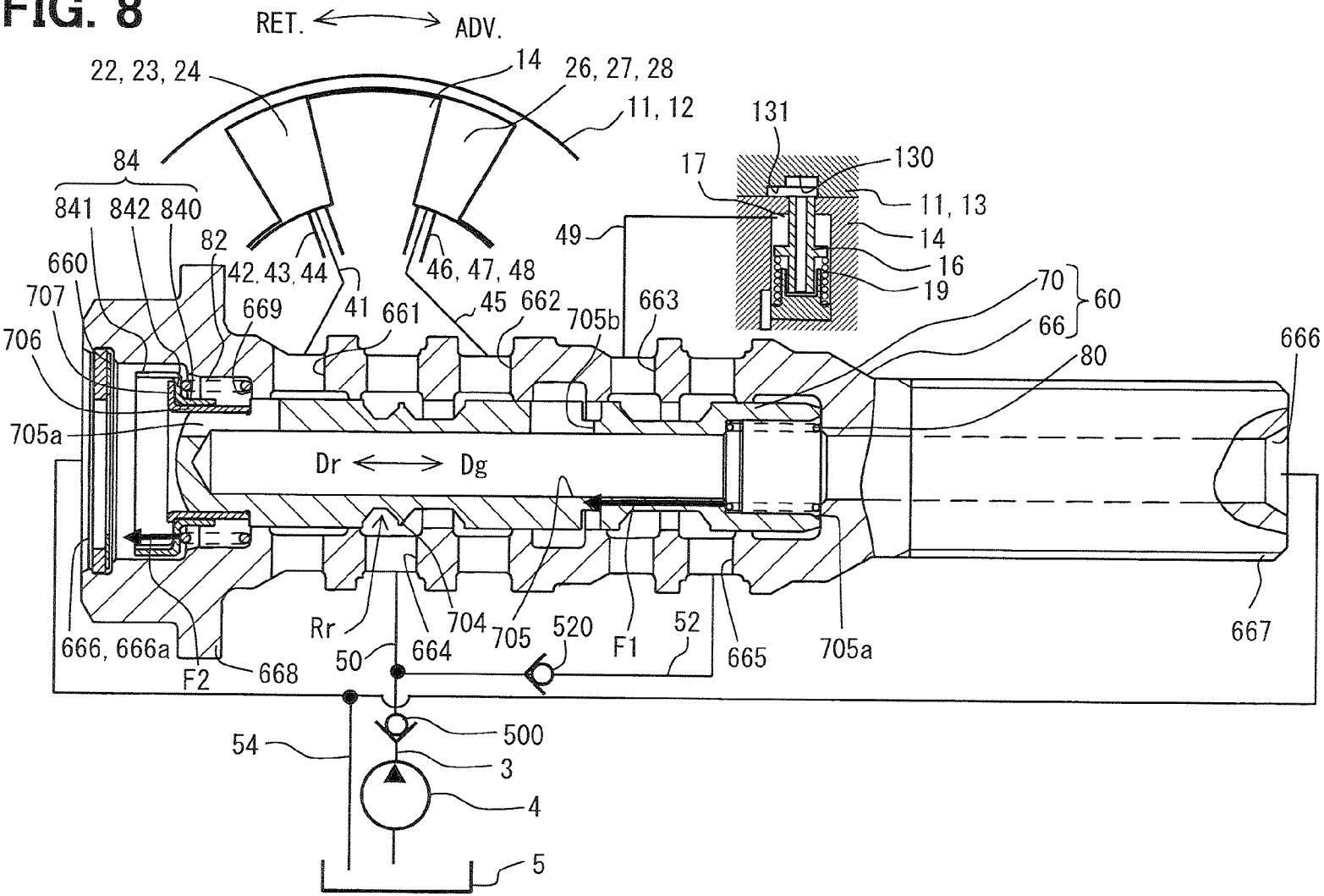
FIG. 8 is a cross sectional view showing one operational position of the control valve in FIG. 4.

The holding region Rh and the retarding region Rr are defined adjacent to each other without any overlap and gap. The retarding region Rr is on the axial forward direction Dg to the holding region Rh. When the spool 70 moves to the retarding region Rr shown in FIG. 10A, the advancing port 661 is connected with the drain ports 666 through the passage 705 as shown in FIG. 8. The hydraulic oil in the advancing chambers 22, 23, 24 is discharged to the drain pan 5 through the passages 42, 43, 44, 41 and the ports 661, 666. When the spool 70 moves to the retarding region Rr, the retarding port 662 is connected with the main-supply port 664. The hydraulic oil supplied from the pump 4 to the passages 3, 50 is introduced into the retarding chambers 26, 27, 28 through the ports 664, 662 and the passage 45, 46, 47, 48. When the spool 70 moves to the retarding region Rr, the lock release port 663 is connected with the sub-supply port 665. The hydraulic oil supplied from the pump 4 to the passages 3, 50, 52 is introduced into the lock release chamber 17 through the ports 665, 663 and the passage 49.

(Driving Mechanism)

Next, components for driving the control valve 60 are explained. The control valve 60 provides a first region and a second region arranged along the axial direction in a region where the spool 70 is movable. As shown in FIG. 1, in order to drive the control valve 60, the control part 40 includes components such as a biasing device in addition to the driving source 90. The biasing device generates and adjusts a biasing force biasing the spool 70 against the driving force. The biasing device includes a resilient member 80, a resilient member 82, and a movable member 84.

The driving source 90 is provided by an electro-magnetic solenoid, and is secured on a mounting part on the internal combustion engine, e.g., a chain cover. The driving source 90 has a drive shaft 91 formed in a columnar shape by metal. The drive shaft 91 is disposed on a side of the spool 70 opposite to a securing portion 667 in a coaxial manner. The drive shaft 91 is supported in a reciprocally movable manner in an axial direction. The drive shaft 91 receives a restoring force of inner spring mounted in the drive source 90 and an electromagnetic force generated by the electromagnetic solenoid. The drive shaft 91 is inserted into one of the drain port 666 formed in the sleeve 66, and always come in contact with an axial end of the spool 70. The drain port 666 receiving the drive shaft 91 may be referred to as the drain port 666*a*. The driving source 90 generates the driving force in accordance with a current that is supplied as an instruction value from the control circuit 96 to the solenoid coil in the driving source 90. The driving force drives and pushes the spool 70 in the axial forward direction Dg shown in FIG. 4 via the drive shaft 91. The driving force drives the spool 70 only toward the axial forward direction.

As shown in FIGS. 4-8, a first resilient member 80 made of a metal compression coil spring is coaxially accommodated in the sleeve 66. The first resilient member 80 is deformed by compressing it by disposing it between the securing portion 667 of the sleeve 66 and an axial end part of the spool 70 close to the securing portion 667. Thereby, the first resilient member 80 generates a first restoring force F1 which pushes and biases the spool 70 in the axial reverse direction Dr. The first resilient member 80 generates the first restoring force F1 for pushing the spool 70 in the axial direction Dr, when the spool 70 is in either the first region or the second region.

A second resilient member 82 made of a metal compression coil spring is coaxially accommodated in the drain port 666*a* of the sleeve 66. The second resilient member 82 is deformed by compressing it by disposing it between the seat portion 669 provided by the drain port 666*a* and the movable member 84. Thereby, the second resilient member 82 generates a second restoring force F2 which pushes and biases the spool 70 in the axial reverse direction Dr. The second resilient member 82 generates the second restoring force F2 for pushing the movable member 84 in the axial direction Dr when the spool 70 is in either the first region or the second region. The first resilient member 80 and the second resilient member 82 generate the first restoring force F1 and the second restoring force F2, respectively, which both push the spool 70 in the reverse direction opposite to the forward direction.

The movable member 84 is capable of being engaged with the spool 70 in the first region to move together with the spool 70. The movable member 84 is capable of resting on the sleeve in the second region to enable the spool 70 to move freely relative to the movable member 84.

The movable member 84 is made of metal, and is formed in a cylindrical shape with a step. The movable member 84 is disposed in and accommodated in the drain port 666*a* in the sleeve 66 in a coaxial manner with the drain port 666*a*. The movable member 84 is supported in a reciprocally movable manner in the axial forward direction Dg and the axial reverse direction Dr. The movable member 84 includes a small diameter portion 840 which provides an innermost portion. A part of the spool 70 provides a bush 706 which is made of metal and is formed in a cylindrical shape with a flange.

Figure 9A:
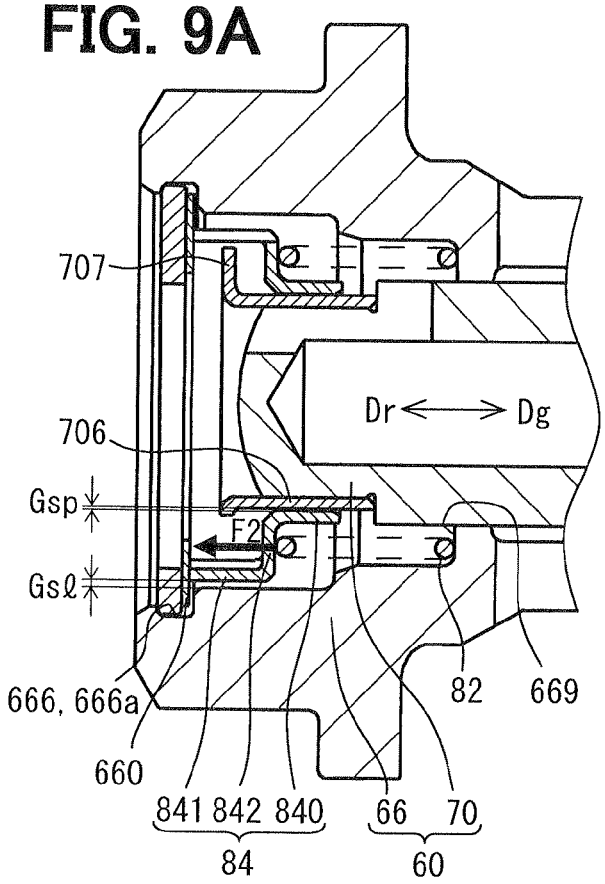
FIG. 9A is a cross sectional view showing one operational position of the control valve in FIG. 4.
Figure 9B:
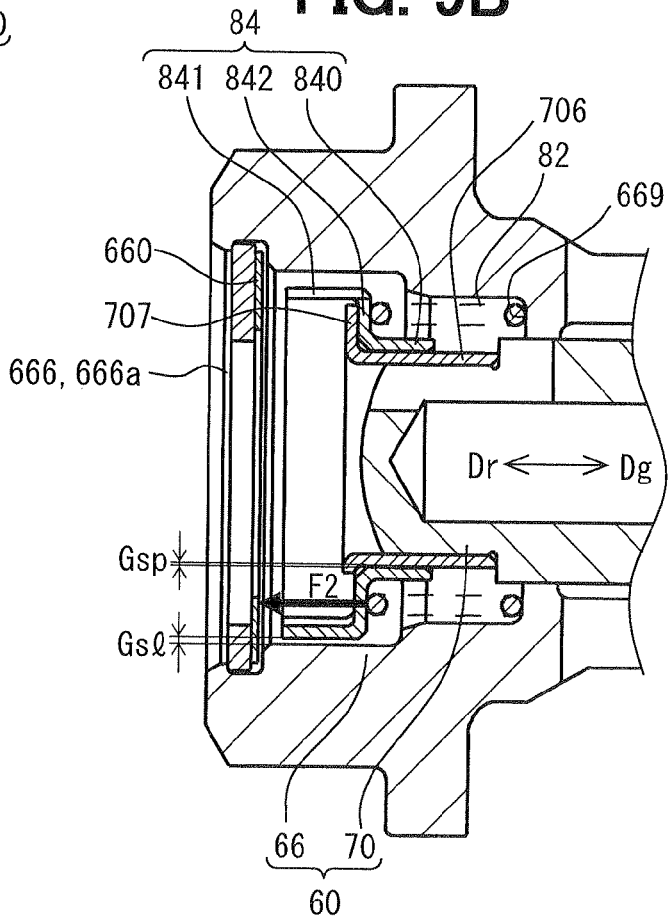
FIG. 9B is a cross sectional view showing one operational position of the control valve in FIG. 4.

The small diameter portion 840 is coupled on the bush 706. The movable member 84 is supported from a radial inside by an outer circumferential surface of the bush 706 in a slidable manner. In other words, the spool 70 supports the movable member 84 via the innermost portion 840 of the movable member 84. The movable member 84 includes a large diameter portion 841 which provides an outermost portion. The large diameter portion 841 is freely inserted in the drain port 666*a* in a coaxial manner. The large diameter portion 841 is distanced from the inner surface of the drain port 666*a* and is kept apart from the inner surface of the drain port 666*a*. The movable member 84 is supported by the spool 70 in a manner that the movable member 84 is apart from the sleeve 66 in a radial direction. The movable member 84 is supported on the spool 70 via a supporting portion between the movable member 84 and the spool 70. The supporting portion is provided by an inner surface and an outer surface. A radial gap Gsl is provided between the movable member 84 and the sleeve 66. A radial gap Gsp is defined on the supporting portion. As shown in FIGS. 9A and 9B, the radial gap Gsl is wider than the radial gap Gsp. Therefore, the movable member 84 is supported on the spool 70 via the supporting portion in a manner that the radial gap Gsl is wider than the radial gap Gsp. In FIGS. 9A and 9B, in order to make an understanding of explanation easy, the radial gap Gsp is illustrated widely emphasized.

The sleeve 66 has a stopper 660 fixed on the drain port 666*a* as a part thereof. The stopper 660 is made of metal and is formed in a circular plate shape. As shown in FIGS. 4-9, the large diameter portion 841 is disposed on the movable member 84 so that the large diameter portion 841 may be rest on the stopper 660 in the axial reverse direction Dr, and may be apart from the stopper 660 in the axial forward direction Dg. The movable member 84 has a stepped portion 842 that connects the small diameter portion 840 and the large diameter portion 841. The flange formed on the bush 706 provides a stopper 707 on the spool 70. The stepped portion 842 is disposed on the movable member 84 so that the stepped portion 842 may be rest on the stopper 707 in the axial reverse direction Dr, and may be apart from the stopper 707 in the axial forward direction Dg. The stepped portion 842 receives the second restoring force F2 in the axial reverse direction Dr by engaging the end of the second resilient member 82. In other words, the end of the second resilient member 82 opposite to the seat portion 669 rests on the stepped portion 842. The movable member 84 provides two states and switches those two states. As shown in FIG. 9A, in one state, the movable member 84 rests on the sleeve 66 by resting the large diameter portion 841 on the stopper 660 in the axial direction. In this state, since the large diameter portion 841 is firmly pressed onto the stopper 660, the movable member 84 is also held to the radial direction. As shown in FIG. 9B, in the other state, the movable member 84 is engaged with the spool 70 by engaging the stepped portion 842 on the stopper 707 in the axial direction. As shown in FIG. 4, the stopper 660 also works as a portion on which the stopper 707 rests when the spool 70 reaches to the end RO in the axial reverse direction Dr.

Figure 11:
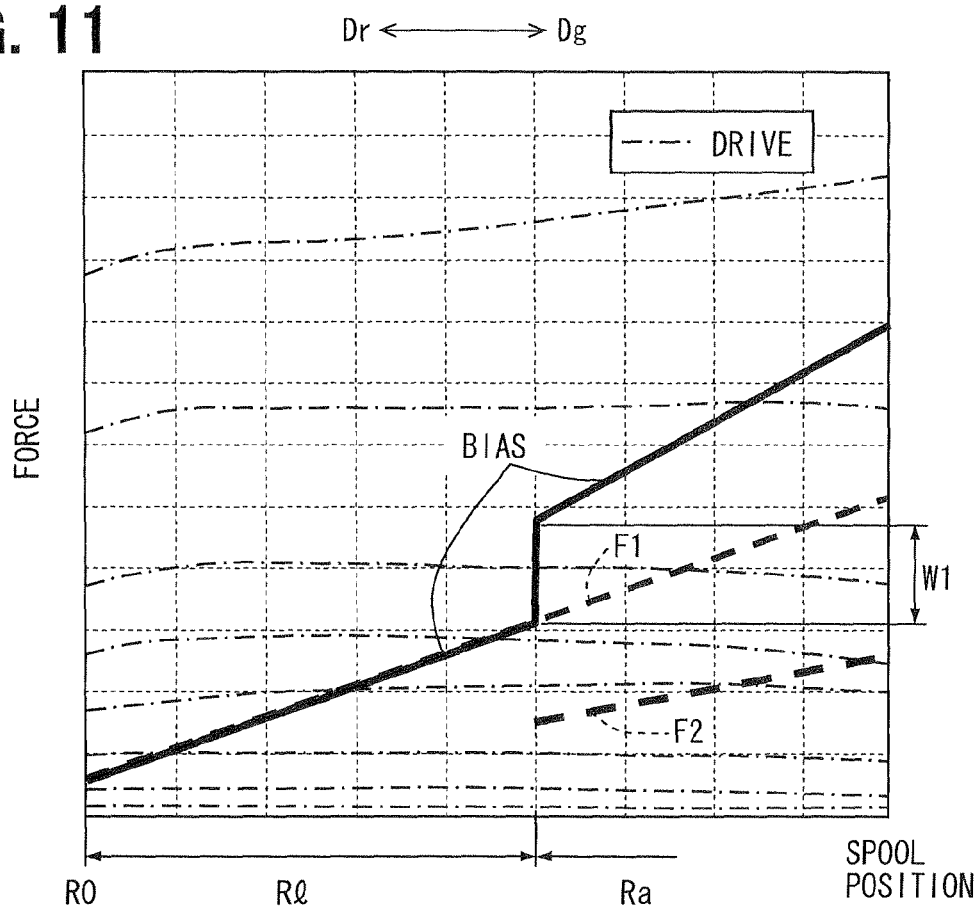
FIG. 11 is a characteristics diagram of the control valve in FIG. 4.

In the lock region Rl shown in FIGS. 4 and 5, the movable member 84 rests on the stopper 660 by the second restoring force F2 of the second resilient member 82. The stopper 707 is disengaged and distanced from the movable member 84 in the axial reverse direction Dr, and the movable member 84 enables the spool 70 to move relatively and freely from the movable member 84. The movable member 84 rests on the sleeve 66 in the lock region Rl, i.e., the second region, to disable the second restoring force F2 to act on the spool 70. In other words, the biasing to the sleeve 70 by the second restoring force F2 is restricted in the lock region Rl. In the lock region Rl, the spool 70 is biased by the first restoring force F1 alone. Therefore, in the lock region Rl, only the first restoring force F1 alone acts independently on the sleeve 70 as the biasing force that biases the spool 70 in the axial reverse direction Dr, as shown in FIG. 11. When no driving force is applied from the driving source 90 to the spool 70, the spool 70 moves to the end position RO of the lock region Rl in the axial reverse direction Dr as shown in FIG. 4. In this state, the stopper 707 rests on the stopper 660 of the sleeve 66.

In the regions Ra, Rh, Rr shown in FIGS. 6, 7, and 8, the movable member 84 engages with the stopper 707 on the spool 70 by the second restoring force F2, and moves together with the spool 70. Therefore, the movable member 84 can be lifted and apart from the stopper 660 of the sleeve 66. The movable member 84 engages with the spool 70 in the regions Ra, Rh, Rr, i.e., the first region, to enable the second restoring force F2 to act on the spool 70. In other words, the spool 70 is biased by both the first restoring force F1 and the second restoring force F2 in the axial reverse direction Dr. Therefore, in the regions Ra, Rh, and Rr, a summed force of the first restoring force F1 and the second restoring force F2 acts on the sleeve 70 as the biasing force that biases the spool 70 in the axial reverse direction Dr, as shown in FIG. 11.

Figure 10B:
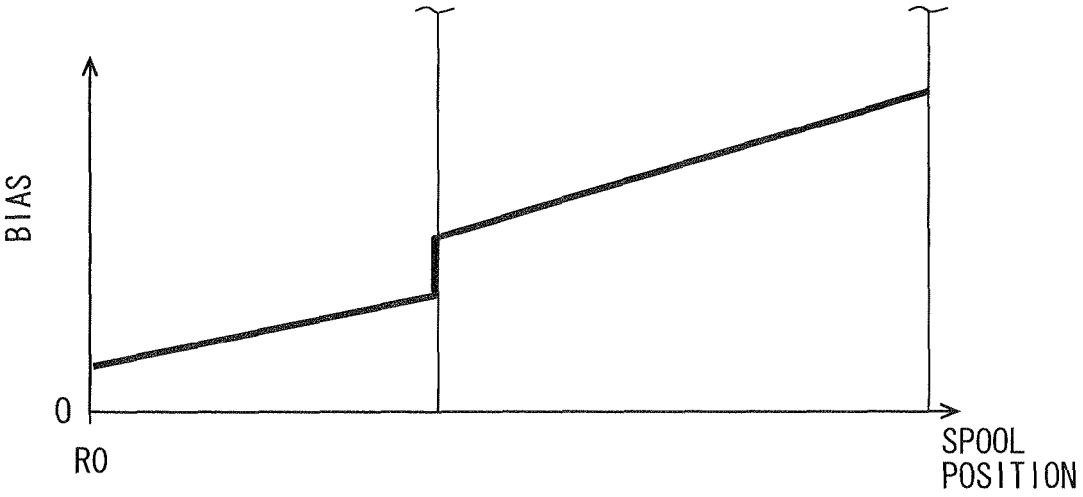
FIG. 10B is a characteristics diagram of the control valve in FIG. 4.

Accordingly, the biasing force may be changed in a step like manner as shown in FIGS. 10A, 10B, and 11. This is caused by switching acting force at a boundary position between the rock region Rl and the advance region Ra. The acting force is switched between the summed force of the second restoring force F2 and the first restoring force F1, and a single force of the first restoring force F1. As shown in FIG. 11, a width W1 of the step like change is set greater than an estimated value of a product variation in driving force which is applied to the spool 70 at the boundary position between the rock region Rl and the advance region Ra from the driving source 90. Accordingly, it is possible to balance the driving force within the estimated value range and the biasing force within the width W1 of the biasing force. The spool position of the spool 70 may be determined based on a balance between the driving force and the biasing force. For example, the spool positions are shown in FIG. 11 by crossing points of a solid line and dashed lines. Therefore, among those spool positions, the spool position at the boundary position between the regions Rl and Ra will not be dependent on the product variation of the driving source 90, and will be dependent only on the product variation of the biasing device, such as the movable member 84. Therefore, even if the driving force is varied for the products, it is still possible to drive the spool 70 to the boundary position, which is defined by the mechanical structure relating to the movable member 84, by a predetermined instruction value. In addition, it is possible to provide required characteristics in the regions Rl and Ra on both sides to the boundary position by obtaining certain differences on both the driving force and the instruction value at the boundary position. In this embodiment, the advancing region Ra corresponds to the first region, and the lock region Rl corresponds to the second region.

(Operation)

Next, operation of the variable valve timing device 1 is explained.

(1) Lock Operation

When the internal combustion engine is at stop state, starting state, or idling state, the pressure of hydraulic oil is relatively low. The control circuit 96 energizes the solenoid of the driving source 90 to drive the control valve 60, so that the spool 70 moves to be positioned in the lock region Rl as shown in FIGS. 4 and 5.

The advancing port 661 communicated with the advancing chambers 22, 23, 24 through the passages 41, 42, 43, 44 is fluidly connected to the main-supply port 664 communicated with the pump 4 through the passages 3, 54. The hydraulic oil supplied from the pump 4 is introduced into the advancing chambers 22, 23, 24. Simultaneously, the retarding port 662 communicated with the retarding chambers 26, 27 28 through the passages 45, 46, 47, 48 is fluidly connected to the discharge port 666 communicated with the passage 54 through the passage 705. The hydraulic oil in the retarding chambers 26, 27, 28 is discharged. Moreover, the lock release port 663 communicated with the lock release chamber 17 through the passage 49 is fluidly connected to the discharge port 666 communicated with the passage 54 through the passage 705. The hydraulic oil in the lock release chamber 17 is discharged.

As described above, when the spool 70 is in the lock range Rl, it is possible perform a lock of phase at the lock phase certainly. The lock is performed by introducing a small amount of the hydraulic oil into the advancing chambers 22, 23, 24, discharging the hydraulic oil from the retarding chambers 26, 27, 28, and discharging the hydraulic oil from the lock release chamber 17. When a rotation of the internal combustion engine is stopped, supplying of the hydraulic oil by the pump 4 and generating of the drive force by the drive source 90 are also stopped. Even in such stopping condition, since the first restoring force F1 acts on the spool 70 as the biasing force, discharging of the hydraulic oil from the lock release chamber 17 is performed at the end position RO in the axial reverse direction Dr. In such stopping condition, the vane rotor 14 still receives the restoring force of the assist spring 18 in the advancing direction and the fluctuation torque shifted in the retarding direction in average, therefore, the rotational phase may be changed and may be reached to the regulated phase region. Then, the lock member 16 can be inserted into the regulated hole 131 and restrict the rotational phase within the regulated phase region. Further, the lock member 16 may be inserted into the lock hole 130. According to the embodiment, the lock member 16 may be easily engaged with the lock hole 130 in the lock phase within the regulated phase region. Therefore, it is possible to move the variable valve timing device to the lock phase certainly within a period of time until a rotation of the internal combustion engine is completely stopped.

(2) Advancing Operation

When the internal combustion engine satisfies an operational condition in which an actual phase is on a retarding side more than a permissible difference from a target phase, the control circuit 96 energizes the solenoid of the driving source 90 to drive the control valve 60, so that the spool 70 moves to be positioned in the advancing region Ra as shown in FIG. 6.

As a result, the advancing port 661 communicated with the advancing chambers 22, 23, 24 through the passages 41, 42, 43, 44 is fluidly connected to the main-supply port 664 communicated with the pump 4 through the passages 3, 50. The hydraulic oil supplied from the pump 4 is introduced into the advancing chambers 22, 23, 24 with relatively large amount compare to the lock operation. Simultaneously, the retarding port 662 communicated with the retarding chambers 26, 27 28 through the passages 45, 46, 47, 48 is fluidly connected to the discharge port 666 communicated with the passage 54 through the passage 705. The hydraulic oil in the retarding chambers 26, 27, 28 is discharged. Moreover, the lock release port 663 communicated with the lock release chamber 17 through the passage 49 is fluidly connected to the sub-supply port 665 communicated with the pump 4 through the passages 3, 50, 52. The hydraulic oil is introduced into the lock release chamber 17.

As described above, when the spool 70 is in the advancing range Ra, the hydraulic oil is introduced into the lock release chamber 17 to unlock the phase, a large amount of the hydraulic oil is introduced into the advancing chambers 22, 23, 24 and the hydraulic oil is discharged from the retarding chambers 26, 27, 28. Accordingly, it is possible to change the valve timing promptly. It is possible to improve response of the VVT in the advancing direction.

(3) Holding Operation

When the internal combustion engine satisfies an operational condition in which an actual phase is within a permissible difference from a target phase, the control circuit 96 energizes the solenoid of the driving source 90 to drive the control valve 60, so that the spool 70 moves to be positioned in the holding region Rh as shown in FIG. 7.

As a result, since the advancing port 661 is disconnected from the other ports, the hydraulic oil in the advancing chambers 22, 23, 24 is kept therein. Simultaneously, since the retarding port 662 is also disconnected from the other ports, the hydraulic oil in the retard chambers 26, 27, 28 is kept therein. In addition, the lock release port 663 is fluidly connected to the sub-supply port 665, so that the hydraulic oil is introduced into the lock release chamber 17.

As described above, when the spool 70 is in the holding range Rh, the hydraulic oil is introduced into the lock release chamber 17 to unlock the phase, and the hydraulic oil is kept in both the advancing chambers 22, 23, 24 and the retarding chambers 26, 27, 28. Accordingly, it is possible to hold the valve timing within a fluctuation of phase caused by the fluctuation torque.

(4) Retarding Operation

When the internal combustion engine satisfies an operational condition in which an actual phase is on an advancing side more than a permissible difference from a target phase, the control circuit 96 energizes the solenoid of the driving source 90 to drive the control valve 60, so that the spool 70 moves to be positioned in the retarding region Rr as shown in FIG. 8.

The advancing port 661 communicated with the advancing chambers 22, 23 24 through the passages 41, 42, 43, 44 is fluidly connected to the drain port 666 communicated with the passage 54 through the passage 705. The hydraulic oil in the advancing chambers 22, 23, 24 is discharged. The retarding port 662 communicated with the retarding chambers 26, 27, 28 through the passages 45, 46, 47, 48 is fluidly connected to the main-supply port 664 communicated with the pump 4 through the passages 3, 50. The hydraulic oil supplied from the pump 4 is introduced into the retarding chambers 26, 27, 28 with relatively large amount similar to the advancing operation. The lock release port 663 is fluidly connected to the sub-supply port 665, so that the hydraulic oil is introduced into the lock release chamber 17.

As described above, when the spool 70 is in the retarding range Rr, the hydraulic oil is introduced into the lock release chamber 17 to unlock the phase, a large amount of the hydraulic oil is introduced into the retarding chambers 26, 27, 28 and the hydraulic oil is discharged from the advancing chambers 22, 23, 24. Accordingly, it is possible to change the valve timing promptly. It is possible to improve response of the VVT in the retarding direction.

(Advantages)

As described above, according to the first embodiment, the control valve 60 can provide a step like change of the biasing force acting on the spool 70 at the boundary position between the lock region Rl and the advancing region Ra. Required characteristics in the regions Rl and Ra are definitely switched according to the spool position. For example, in the lock region Rl, it is required to perform a lock and unlock operation properly. In the advancing region Ra, it is required to perform an advancing operation properly. According to the control valve 60, it is possible to perform required characteristics in regions respectively.

As shown in FIGS. 9A and 9B, the movable member 84 is distanced inwardly from the sleeve 66 by a wide gap Gsl. In the advance region Ra where the movable member 84 and the spool 70 are axially engaged and move together, the movable member 84 can move without contacting radially with the sleeve 66. Therefore, the spool 70, which is engaged with the movable member 84, receives a sliding resistance that is reduced to a certain low level.

Since the movable member 84 is supported on the spool 70 via the small diameter portion 840, it is possible to reduce a radius for supporting the movable member 84. As a result, a moment generated when the movable member 84 is inclined and pushed toward the spool 70 by a radial side force could not easily become large. Even if the movable member 84 receives a side force in the radial direction by inclining the acting direction of the second restoring force F2 from the axial direction of the sleeve 66, since it is possible to suppress pushing to the spool 70, a movement resistance acting on the spool 70 may be kept small.

Figure 12:
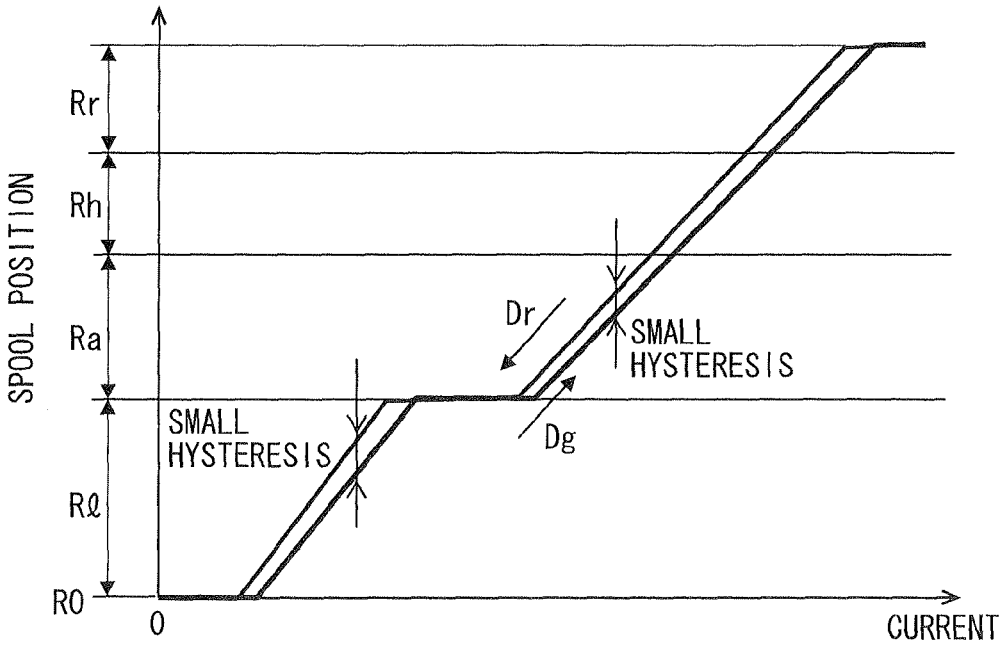
FIG. 12 is a characteristics diagram of the control valve in FIG. 4.

FIG. 12 shows a relationship between a spool position and the instruction value to the driving source 90. As shown in FIG. 12, in the second region, there may be a small amount of hysteresis on the spool position between a movement in an axial forward direction Dg and a movement in an axial reverse direction Dr. In addition, as shown in FIG. 12, the hysteresis reduction effect may be also performed by the similar principle in the holding region Rh and the retarding region Rr. The holding region Rh and the retarding region Rr are defined on a side of the advancing region Ra that is one side while the lock region Rl is defined on the opposite other side of the advancing region Ra.

In addition, the movable member 84 is supported by the spool 70 from the radial inside. Therefore, in the lock region Rl where the movable member 84 rests on the sleeve 66, since the spool 70 can move relative to the movable member 84 during contacting the movable member 84 in a radial direction, the spool 70 receives a movement resistance corresponding to a sliding resistance between the components, such as the spool 70 and the movable member 84. Since the movable member 84 is in the state where the movable member 84 rests on and pushed against the stopper 660 of the sleeve 66 by the second restoring force F2 of the second resilient member 82, a pushing force on the movable member 84 toward the spool 70 caused by a radial side force may be suppressed. Therefore, the sliding resistance which is generated between the spool 70 and the movable members 84 and acts on the spool 70 may become small. In this embodiment, the movable member 84 has a cylindrical inside surface on the small diameter portion 840 that is supported on a spool outside surface of the spool 70 in a slidable manner. The movable member 84 rests on the sleeve 66 via a circular end thereof to keep the cylindrical inside surface parallel to the spool outside surface. Therefore, it is possible to keep a sliding resistance low and stable.

As shown in FIG. 12, which shows a relationship between a spool position and the instruction value to the driving source, in the lock region Rl where the movement resistance may become low, there may be a small amount of hysteresis between a movement in the axial forward direction Dg and a movement in the axial reverse direction Dr. In addition, since a fluctuation of friction between the spool 70 and the movable member 84 is reduced to a sufficiently low level, it is possible to suppress a stick-slip in the lock region Rl.

As mentioned above, according to the first embodiment which can suppress the hysteresis and the stick slip about the spool position, it is possible to perform a high suppressing effect about the variation in the response characteristic of the control valve 60 resulting from the movement resistance of the spool 70.

Second Embodiment

Figure 13:
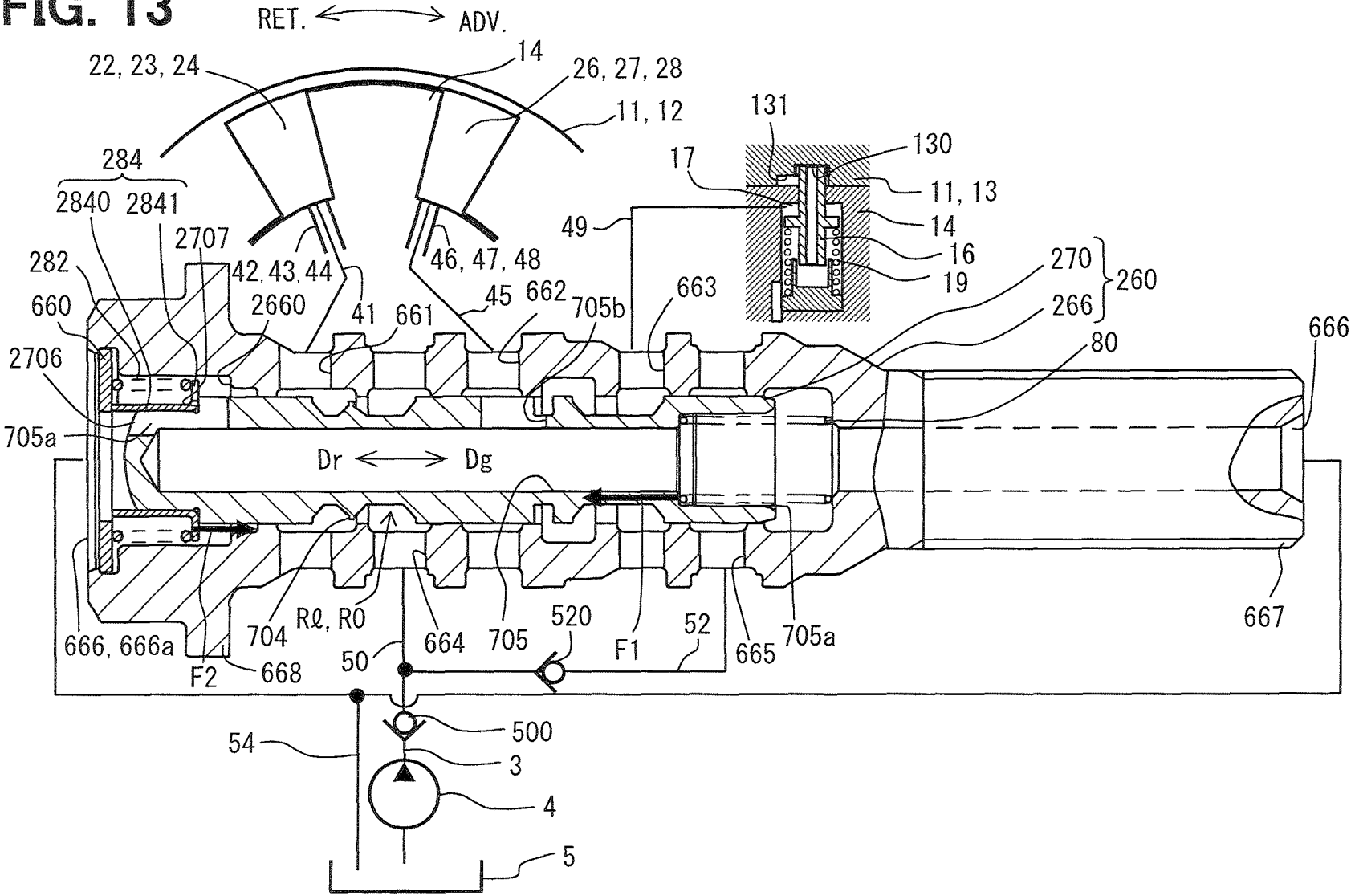
FIG. 13 is a cross sectional view of a control valve for a variable valve timing device according to a second embodiment of the present invention.
Figure 14:
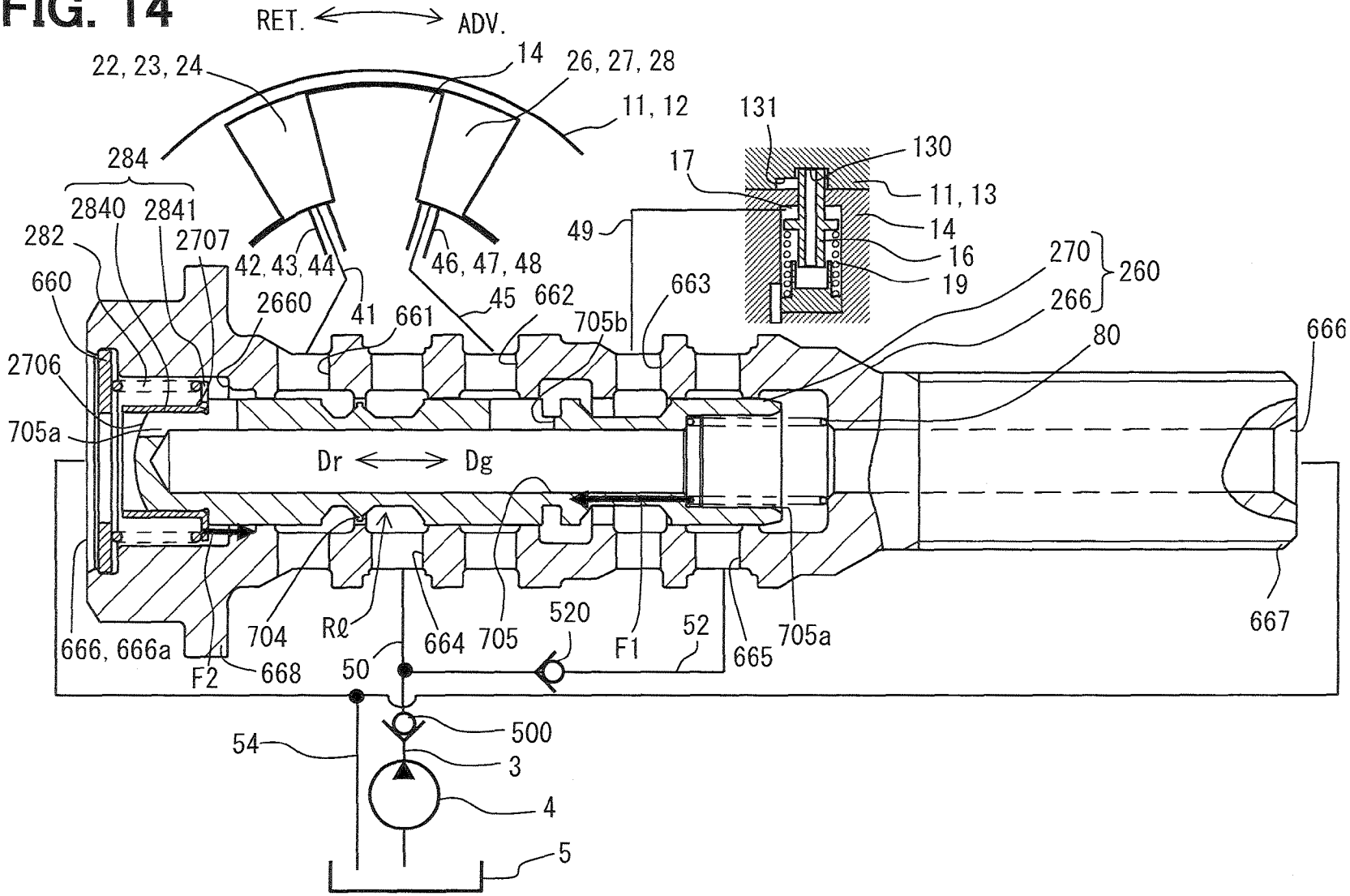
FIG. 14 is a cross sectional view showing one operational position of the control valve in FIG. 13.

As shown in FIG. 13, the second embodiment is a modification of the first embodiment.

(Drive Mechanism)

Hereafter, components of a control valve 260 in the second embodiment that are different from the first embodiment are mainly explained. As shown in FIGS. 13-17, the biasing device includes a first resilient member 80 and a second resilient member 282. The second resilient member 282 made of a metal compression coil spring is coaxially accommodated in the drain port 666*a* of the sleeve 266 disposed within the rotary components 2, 14. The second resilient member 82 is deformed by compressing it by disposing it between the stopper 660 fixed on the drain port 666*a* and the movable member 284. Thereby, the second resilient member 282 generates a second restoring force F2 which pushes and biases the movable member 284 in the axial forward direction Dg. The second resilient member 82 generates the second restoring force F2 for pushing the movable member 284 in the axial direction Dg when the spool 270 is in either the first region or the second region.

Figure 18A:
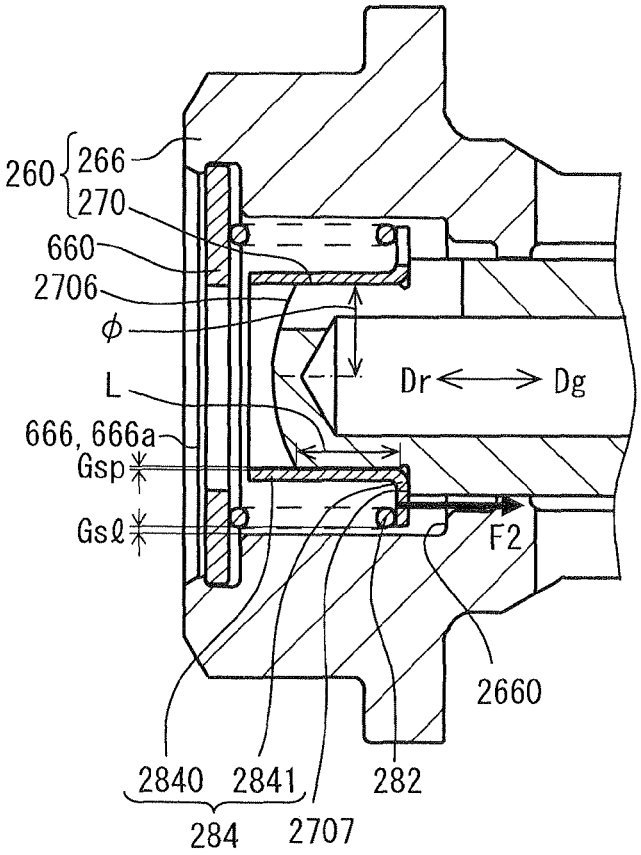
FIG. 18A is a cross sectional view showing one operational position of the control valve in FIG. 13.
Figure 18B:
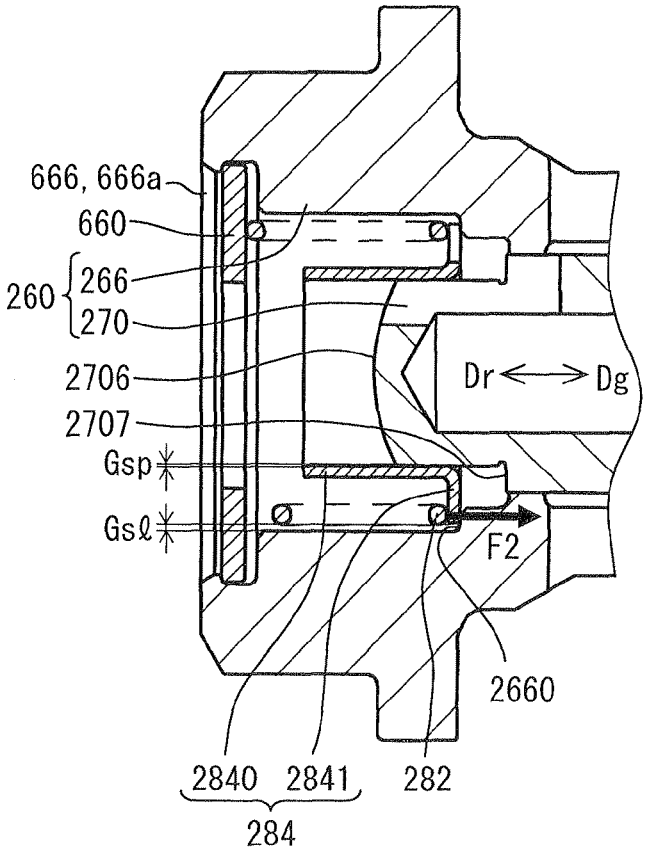
FIG. 18B is a cross sectional view showing one operational position of the control valve in FIG. 13.

The biasing device includes the movable member 284. The movable member 284 is made of metal, and is formed in a cylindrical shape with a flange. The movable member 284 is disposed in and accommodated in the drain port 666*a* in the sleeve 266 in a coaxial manner with the drain port 666*a*. The movable member 284 is supported in a reciprocally movable manner in the axial forward direction Dg and the axial reverse direction Dr. The movable member 284 includes a main-cylindrical portion 2840 which provides an innermost portion, i.e., a small diameter portion. A part of the spool 270 provides an axial end portion 2706, i.e., a bush. The main-cylindrical portion 2840 is coupled on the axial end portion 2706. The movable member 284 is supported from a radial inside by an outer circumferential surface of the axial end portion 2706 in a slidable manner. In other words, the spool 270 supports the movable member 284 via the main-cylindrical portion 2840 of the movable member 84. The movable member 84 includes a flange portion 2841 which provides an outermost portion, a large diameter portion. The flange portion 2841 is freely inserted in the drain port 666*a* in a coaxial manner. The flange portion 2841 is inwardly distanced from the inner surface of the drain port 666*a* and is kept apart from the inner surface of the drain port 666*a*. The movable member 284 is supported by the spool 270 in a manner that the movable member 284 is apart from the sleeve 266 in a radial direction. The movable member 284 is supported on the spool 270 via a supporting portion between the movable member 284 and the spool 270. The supporting portion is provided by an inner surface and an outer surface. A radial gap Gsl is provided between the flange portion 2841 and the sleeve 266. A radial gap Gsp is defined on the supporting portion. The radial gap Gsp corresponds to a gap enabling sliding motion. As shown in FIGS. 18A and 18B, the radial gap Gsl is wider than the radial gap Gsp. Therefore, the movable member 284 is supported on the spool 270 via the supporting portion in a manner that the radial gap Gsl is wider than the radial gap Gsp. In FIGS. 18A and 18B, in order to make an understanding of explanation easy, the radial gap Gsp is illustrated widely emphasized.

The sleeve 266 has a stopper 2660 formed on the drain port 666*a* as a part thereof. The stopper 2660 is formed in a circular plan shape. As shown in FIGS. 13-18, the flange 2841 is disposed on the movable member 284 so that the flange 2841 may be rest on the stopper 2660 in the axial forward direction Dg, and may be apart from the stopper 2660 in the axial reverse direction Dr. The spool 270 provides a stopper 2707 by an axial end 2706 thereof. The stopper 2707 is formed in a circular plan shape. The flange 2841 is disposed on the movable member 284 so that the flange may be rest on the stopper 2707 in the axial forward direction Dg, and may be apart from the stopper 2707 in the axial reverse direction Dr. The flange 2841 receives the second restoring force F2 in the axial forward direction Dg by engaging the end of the second resilient member 282. In other words, the end of the second resilient member 282 opposite to the stopper 660 rests on the flange 2841. The movable member 284 provides two states and switches those two states. As shown in FIG. 18B, in one state, the movable member 284 rests on the sleeve 266 by resting the flange 2841 on the stopper 2660 in the axial direction. In this state, since the flange 2841 is firmly pressed onto the stopper 2660, the movable member 284 is also held to the radial direction. As shown in FIG. 18A, in the other state, the movable member 284 is engaged with the spool 270 by engaging the flange 2841 on the stopper 2707 in the axial direction. As shown in FIG. 13, the stopper 660 also works as a portion on which the stopper 2707 rests via the movable member 284 when the spool 270 reaches to the end RO in the axial reverse direction Dr.

Figure 17:
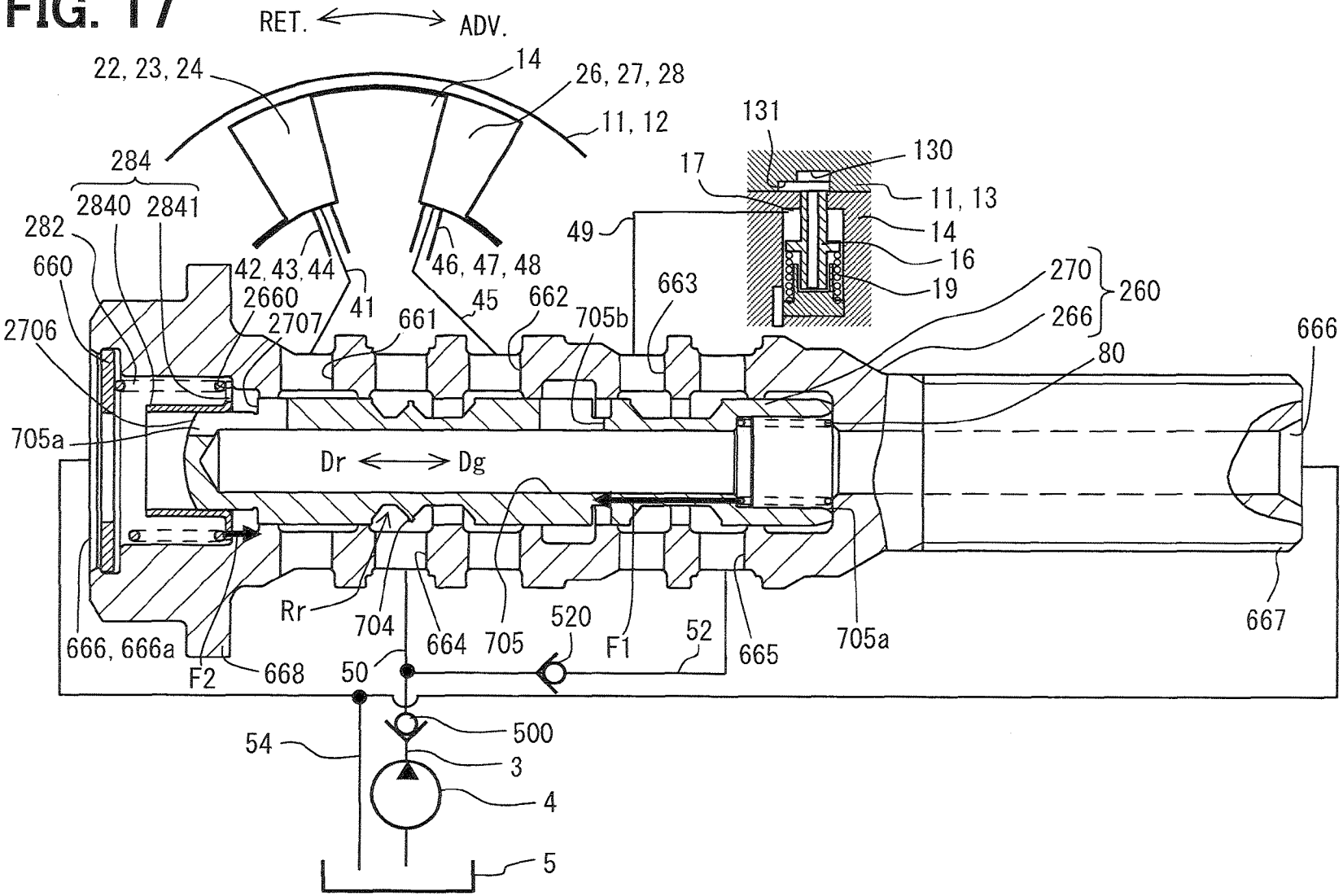
FIG. 17 is a cross sectional view showing one operational position of the control valve in FIG. 13.
Figure 19:
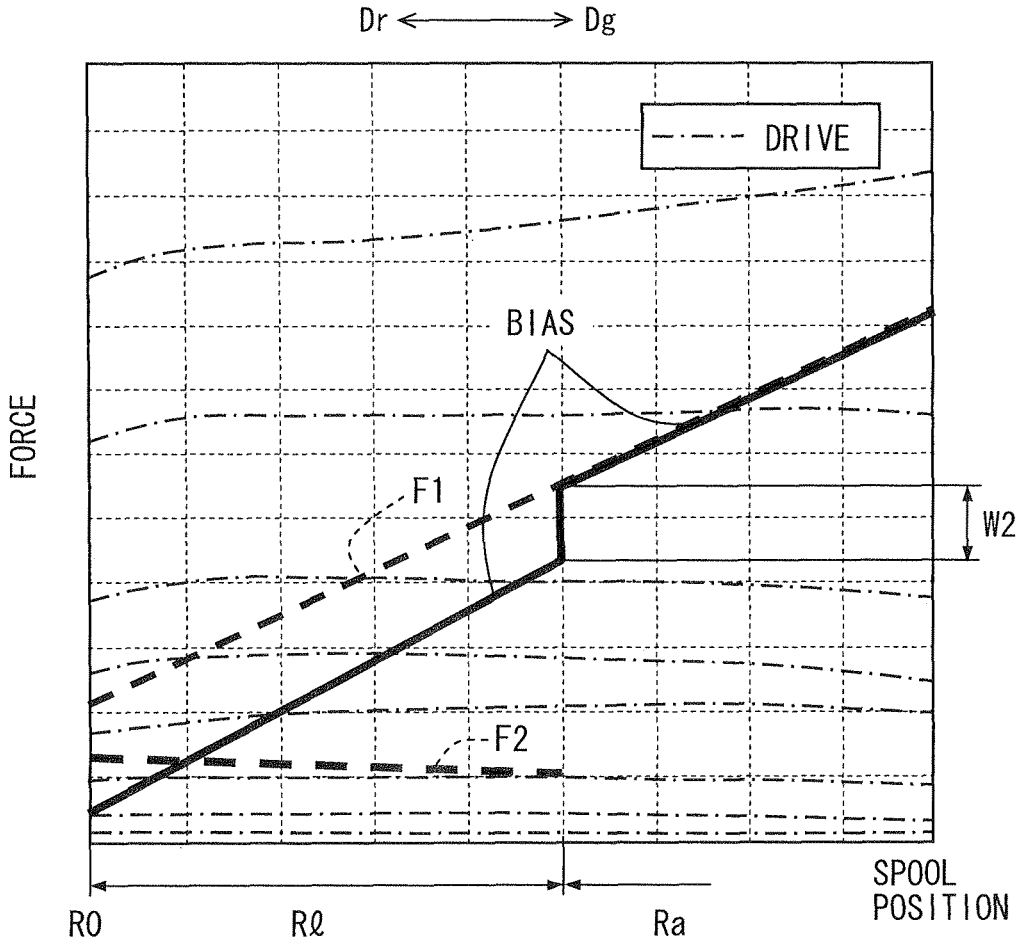
FIG. 19 is a characteristics diagram of the control valve in FIG. 13.

In the lock region Rl shown in FIGS. 13 and 17, the movable member 284 engages with the stopper 2707 on the spool 270 by the second restoring force F2 in the axial forward direction Dg generated by the second resilient member 282, and moves together with the spool 270. Therefore, the movable member 284 can be lifted and apart from the stopper 2660 of the sleeve 266. As shown in FIG. 19, in the lock region Rl of the second embodiment, the second restoring force F2 is adjusted smaller than the first restoring force F1 of the first resilient member 80 which acts on the counter direction Dr. The first resilient member 80 generates the first restoring force F1 which pushes the spool 270 in the reverse direction opposite to the forward direction. The second resilient member 282 generates the second restoring force F2 that pushes the spool 270 in the forward direction and is smaller than the first restoring force F1 in the first region. In other words, the spool 270 is biased in the axial reverse direction Dr by acting the first restoring force F1 that is greater than the second restoring force F2. Therefore, in the lock region Rl, a summed force of the first restoring force F1 and the second restoring force F2, i.e., a differential force of the first restoring force F1 and the second restoring force F2, acts on the sleeve 270 as the biasing force that biases the spool 270 in the axial reverse direction Dr, as shown in FIG. 19. In this second embodiment, the movable member 284 is supported on the spool 270 via a supporting portion, i.e., the main-cylindrical portion 2840. The main-cylindrical portion 2840 has a supporting radius "ϕ (Phi)" and an axial supporting length "L" in the lock region Rl, i.e., the first region as shown in FIG. 18A. The axial supporting length L is the same as the maximum supporting length in the advancing region Ra. The supporting radius "ϕ (Phi)" is smaller than the axial supporting length "L" when the spool 270 is in the lock region Rl.

When no driving force is applied from the driving source 90 to the spool 270, the spool 270 moves to the end position RO of the lock region Rl in the axial reverse direction Dr as shown in FIG. 13. In this state, the stopper 2707 rests on the stopper 660 of the sleeve 266 via the movable member 284. Therefore, in a case that the lock operation similar to the first embodiment is performed when a rotation of the internal combustion engine is stopped, since a summed force of the first and the second restoring force F1 and F2 act on the spool 270 as the biasing force, discharging of the hydraulic oil from the lock release chamber 17 is performed at the end position RO in the axial reverse direction Dr. Therefore, similar to the first embodiment, it is possible to move the variable valve timing device to the lock phase certainly within a period of time until a rotation of the internal combustion engine is completely stopped.

Figure 15:
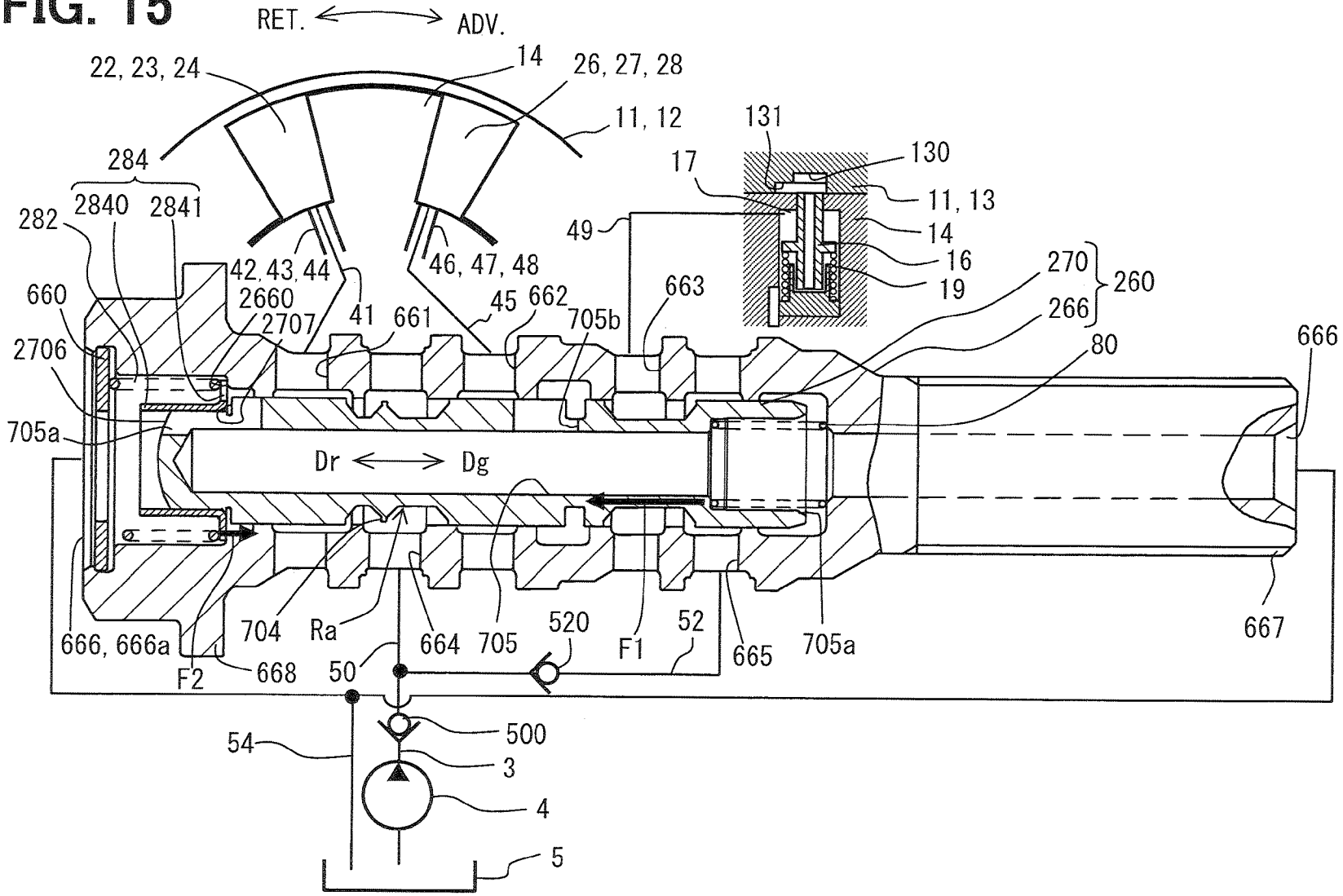
FIG. 15 is a cross sectional view showing one operational position of the control valve in FIG. 13.
Figure 16:
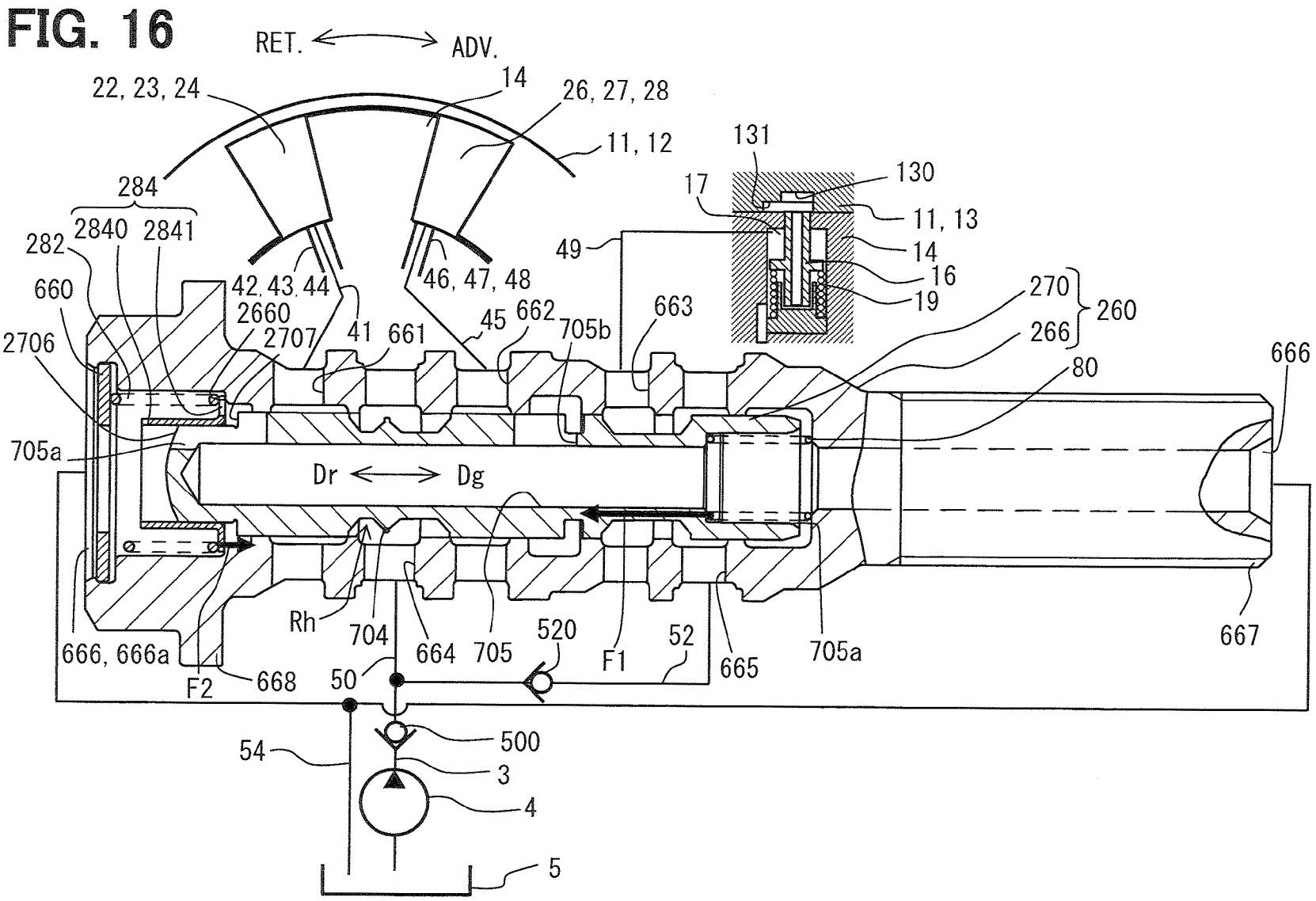
FIG. 16 is a cross sectional view showing one operational position of the control valve in FIG. 13.

In the regions Ra, Rh, Rr shown in FIGS. 15, 16, and 17, the movable member 284 rests on the stopper 2660 by the second restoring force F2 of the second resilient member 282. The stopper 2707 is disengaged and distanced from the movable member 284 in the axial forward direction Dg, and the movable member 284 enables the spool 270 to move relatively and freely from the movable member 284. In other words, the biasing to the sleeve 270 by the second restoring force F2 is restricted in the regions Ra, Rh, Rr. In the regions Ra, Rh, Rr, the spool 270 is biased by the first restoring force F1 alone. Therefore, in the regions Ra, Rh, Rr, only the first restoring force F1 alone acts independently on the sleeve 270 as the biasing force that biases the spool 270 in the axial reverse direction Dr, as shown in FIG. 19.

Accordingly, the biasing force may be changed in a step like manner as shown in FIG. 19. This is caused by switching acting force at a boundary position between the rock region Rl and the advance region Ra. The acting force is switched between the summed force of the second restoring force F2 and the first restoring force F1, and a single force of the first restoring force F1. Similar to the first embodiment, a width W2 of the step like change is set greater than an estimated value of a product variation in driving force which is applied to the spool 70 at the boundary position between the rock region Rl and the advance region Ra from the driving source 90. Therefore, the boundary position is dependent only on the product variation of the biasing device, such as the movable member 284. In this embodiment, the lock region Rl corresponds to the first region, and the advancing region Ra corresponds to the second region.

(Advantages)

As described above, according to the second embodiment, the control valve 260 can provide a step like change of the biasing force acting on the spool 70 at the boundary position between the lock region Rl and the advancing region Ra. Required characteristics in the regions Rl and Ra are definitely switched by the spool position at the boundary position. For example, in the lock region Rl, it is required to perform a lock and unlock operation properly. In the advancing region Ra, it is required to perform an advancing operation properly. According to the control valve 260, it is possible to perform required characteristics in both regions respectively.

As shown in FIGS. 18A and 18B, the movable member 284 is radially distanced from the sleeve 266 by the large gap Gsl. In the lock region Rl where the movable member 284 and the spool 270 are axially engaged and move together, the movable member 284 can move without contacting radially with the sleeve 266. Therefore, the spool 270, which is engaged with the movable member 284, receives a sliding resistance that is reduced to a certain low level.

Since the movable member 284 supported by the supporting radius is small enough for becomes small about the movable member 284 by which the body cylinder part 2840 of the "innermost portion" is supported by the spool 270, the moment generated in the direction which inclines according to the side force of the path direction, and is forced on the spool 70 cannot become large easily. Since the movable member 284 and the spool 270 provide the supporting radius "ϕ (Phi)" that is smaller than the axial supporting length L in the lock region Rl, the movable member may not be easily inclined. Even if the movable member 284 receives a side force in the radial direction by inclining the acting direction of the second restoring force F2 from the axial direction of the sleeve 266, since it is possible to suppress pushing to the spool 270, a movement resistance acting on the spool 270 may be kept small.

In this embodiment, it is also possible to suppress an amount of hysteresis in a similar way of the first embodiment. In the lock region Rl where the movement resistance on the spool 270 is kept small, there may be a small amount of hysteresis on the spool position between a movement in the axial forward direction Dg and a movement in the axial reverse direction Dr.

In addition, the movable member 284 is supported by the spool 270 from the radial inside. Therefore, in the advance region Ra where the movable member 284 rests on the sleeve 266, since the spool 270 can move relative to the movable member 284 during contacting the movable member 284 in a radial direction, the spool 270 receives a movement resistance corresponding to a sliding resistance between the components, such as the spool 270 and the movable member 284. Since the movable member 284 is in the state where the movable member 284 rests on and pushed against the stopper 2660 of the sleeve 266 by the second restoring force F2 of the second resilient member 282, a pushing force on the movable member 284 toward the spool 270 caused by a radial side force may be suppressed. Therefore, the sliding resistance which is generated between the spool 270 and the movable member 284 and acts on the spool 270 may become small.

In this embodiment, it is also possible to suppress an amount of hysteresis in a similar way of the first embodiment. In the advance region Ra where the movement resistance on the spool 270 is kept small, there may be a small amount of hysteresis on the spool position between a movement in the axial forward direction Dg and a movement in the axial reverse direction Dr. In addition, since a fluctuation of friction between the spool 270 and the movable member 284 is reduced to a sufficiently low level, it is possible to suppress a stick-slip in the advance region Ra. The hysteresis reduction effect and the stick slip reduction effect may be also performed in the holding region Rh and the retarding region Rr. The holding region Rh and the retarding region Rr are defined on a side of the advancing region Ra that is one side while the lock region Rl is defined on the opposite other side of the advancing region Ra.

As mentioned above, according to the second embodiment which can suppress the hysteresis and the stick slip about the spool position, it is possible to perform a high suppressing effect about the variation in the response characteristic of the control valve 260 resulting from the movement resistance of the spool 270.

Other Embodiments

Although the present invention is described based on the illustrated embodiments, the present invention should not be limited to such embodiments illustrated, may be implemented in other ways and be applied to any combinations and modifications without departing from the scope of the invention.

For example, in the first and second embodiments, a switching position where the biasing force to the spool 70, 270 against the driving force of the driving source 90 is switched in a step like manner is set on a boundary position between the region Rl and the region Ra. In stead of the above arrangement, the switching position may be set on a boundary position between the region Ra and the region Rh. In addition, the switching position may be set on a boundary position between divided partial regions provided by dividing one of the regions Rl, Ra, Rh, Rr. In those embodiments, one of the first region and the second region includes a region in which the vane rotor is controlled to change the rotational phase. The other one of the first region and the second region includes a region in which the vane rotor is controlled to lock the rotational phase in a middle phase between a most advanced phase and a most retarded phase.

In the embodiments, the movable members 84 and 284 are supported at the portions 840 and 2840 provided as the innermost portions. However, the movable members may be supported at portions placed radial outer side than the innermost portions by the spools 70 and 270. In the first embodiment, the supporting radius of the movable member 84 by the spool 70 is set a value equal to, or larger than the axial supporting length in the region when the movable member 84 and the spool 70 move together. However, the supporting length may be set a value smaller than the supporting length similar to the second embodiment. In the second embodiment, the supporting radius of the movable member 284 by the spool 270 may be set a value equal to or larger than the axial supporting length in the region when the movable member 284 and the spool 270 move together. The axial supporting length of the movable member 284 by the spool 270 is variable when the movable member 284 enables the spool 270 to move relative to the movable member 284.

Figure 20A:
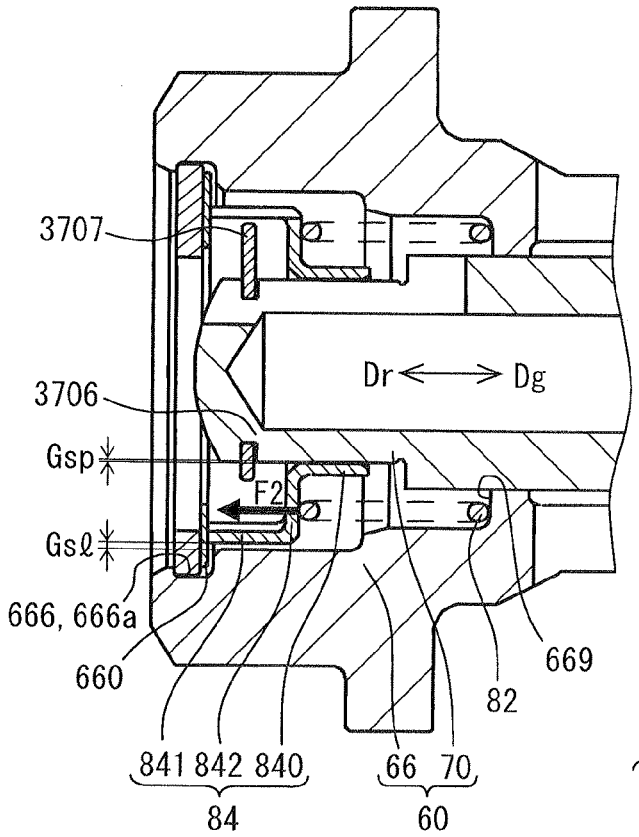
FIG. 20A is a cross sectional view showing a modified embodiment of the control valve.
Figure 20B:
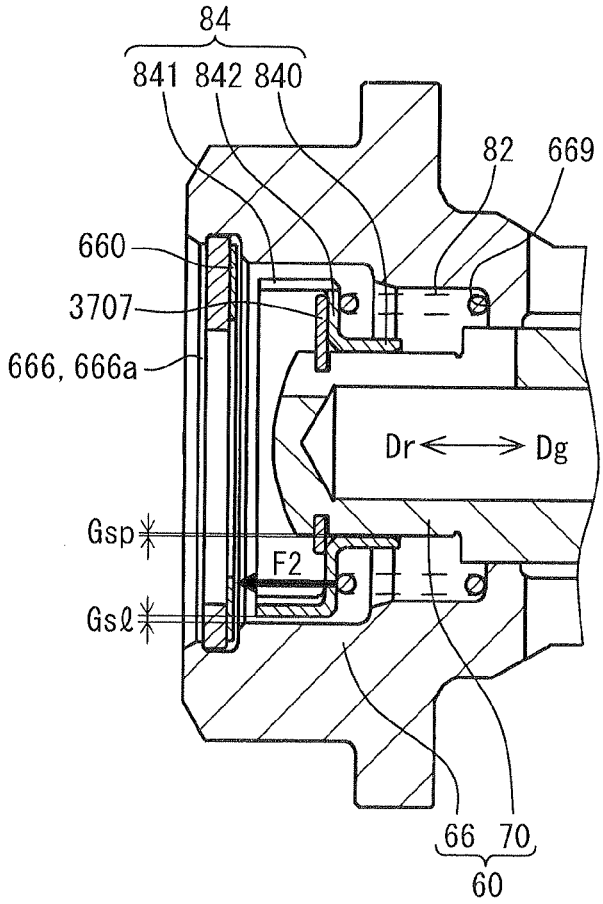
FIG. 20B is a cross sectional view showing a modified embodiment of the control valve.
Figure 21:
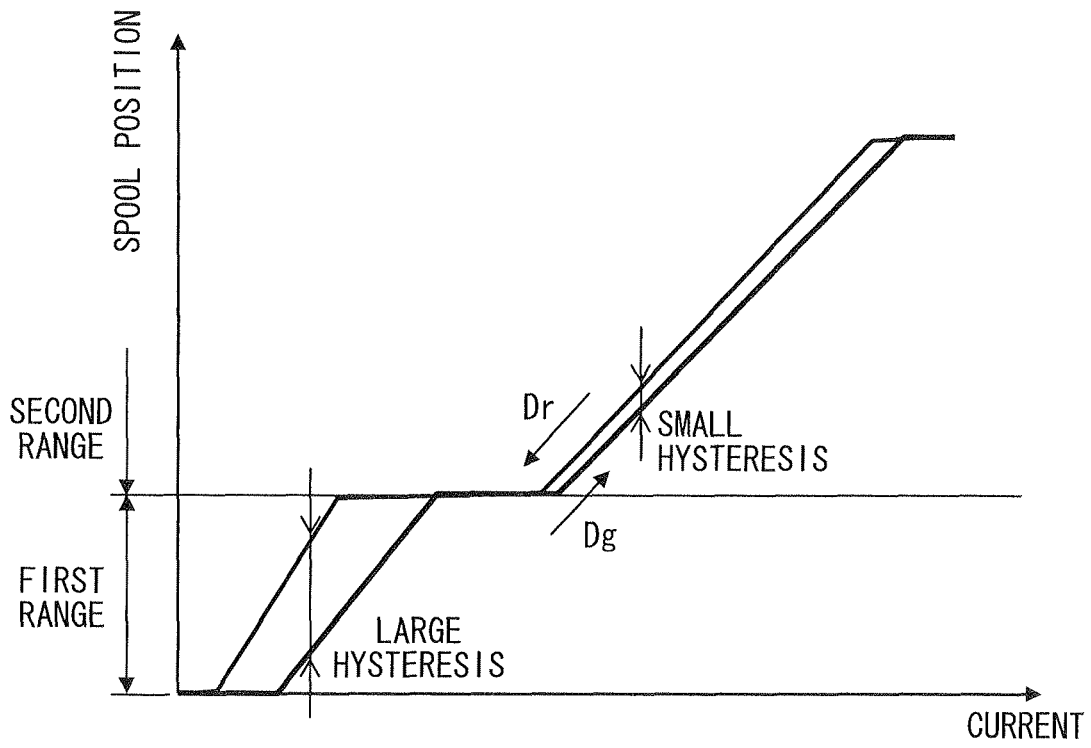
FIG. 21 is a characteristics diagram of a prior art.

In the first and second embodiment, the sleeve 66, 266, which accommodates the spool 70, 270, the resilient member 80, 82, 282, and the movable member 84, 284, are accommodated within the rotary components 2, 14. In stead of the above arrangement, the sleeve 66, 266 may be disposed within one component of the rotary components 2, 14. In addition, the sleeve 66, 266 may be disposed axial or radial outside of the rotary components 2, 14. FIGS. 20A and 20B show a modification of the first embodiment. A circular-plate-shaped snap ring 3707 may be attached on the spool 70 as an alternative part acting as the bush 706 which is formed in a cylindrical shape with a flange. In this case, a small diameter portion 840 of the movable member 84 is supported from a radial inside with a radial gap Gsp by the axial end part 3706 of the spool 70. In addition, the movable member 84 has the stepped portion 842 that is disposed to be possible to be engaged with the snap ring 3707 in the axial reverse direction Dr, and to be apart from the snap ring 3707 in the axial forward direction Dg.

In addition, in the first and second embodiment, the lock phase is set at the middle position between the most retarded phase and the most advanced phase. However, instead of the above arrangement, the lock phase may be set at the most retarded phase or the most advanced phase. In such arrangements, it is possible to eliminate components for pushing the vane rotor 14 by the assist spring 18. In the embodiments, the regulated hole 131 is formed to define the regulated phase region. Alternatively, the present invention may be applied to a device that has no regulated hole 13. In addition, the present invention may be applied to a device that has a plurality of lock members which are provided by dividing the lock member 16 and are biased by lock springs 19 respectively.

In the embodiment, the present invention is applied to the device for varying the valve timing of the intake valve. The present invention may be applied to a device for varying the valve timing of an exhaust valve, or a device for varying the valve timing of both the intake valve and the exhaust valve.

Although the present invention has been fully described in connection with the preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A variable valve timing device for adjusting a valve timing of a valve being opened/closed by a camshaft which is driven by a torque transmitted from a crankshaft of an internal combustion engine, the variable valve timing device comprising:

a housing defining a hydraulic chamber therein;

a vane rotor disposed to define an advancing chamber and a retarding chamber by dividing the hydraulic chamber in a rotational direction, the vane rotor being rotatable to change a rotational phase relative to the housing in response to hydraulic fluid introduced into one of the advancing chamber and the retarding chamber;

a control valve having a sleeve and a spool disposed in the sleeve in a reciprocally movable manner, the control valve being adapted to control in-flow and out-flow of the hydraulic fluid with respect to both the advancing chamber and the retarding chamber by adjusting a spool position in an axial direction;

a driving source which changes the spool position by generating a driving force of the spool in response to an instruction value; and a biasing device which generates and adjusts a biasing force biasing the spool against the driving force, wherein the control valve provides a first region and a second region arranged along the axial direction in a region where the spool is movable, and wherein the biasing device includes:

a movable member which is capable of being engaged with the spool in the first region to move together with the spool, and is capable of resting on the sleeve in the second region to enable the spool to move relative to the movable member;

a first resilient member which generates a first restoring force for pushing the spool in the axial direction when the spool is in both the first region and the second region; and a second resilient member which generates a second restoring force for pushing the movable member in the axial direction when the spool is in both the first region and the second region, wherein the movable member engages with the spool in the first region to enable the second restoring force to act on the spool, and rests on the sleeve in the second region to disable the second restoring force to act on the spool, and wherein the movable member is supported by the spool in a manner that the movable member is apart from the sleeve in a radial direction.

2. The variable valve timing device in claim 1, wherein the movable member is formed in a cylindrical shape.

3. The variable valve timing device in claim 2, wherein the movable member is supported from a radial inside thereof by the spool.

4. The variable valve timing device in claim 3, wherein the movable member has a cylindrical inside surface that is supported on a spool outside surface of the spool in a slidable manner, and the movable member rests on the sleeve via a circular end thereof to keep the cylindrical inside surface parallel to the spool outside surface.

5. The variable valve timing device in claim 1, wherein the movable member is supported on the spool via a supporting portion between the movable member and the spool in a manner that a radial gap between the movable member and the sleeve is wider than a radial gap defined on the supporting portion.

6. The variable valve timing device in claim 1, wherein the spool supports the movable member via the innermost portion of the movable member.

7. The variable valve timing device in claim 1, wherein the movable member is supported on the spool via a supporting portion which has a supporting radius and an axial supporting length, the supporting radius being smaller than the axial supporting length when the spool is in the first region.

8. The variable valve timing device in claim 1, wherein the driving source generates the driving force that drives the spool only toward a forward direction in the axial direction, and wherein the first resilient member and the second resilient member generate the first restoring force and the second restoring force, respectively, which both push the spool in a reverse direction opposite to the forward direction.

9. The variable valve timing device in claim 1, wherein the driving source generates the driving force that drives the spool only toward a forward direction in the axial direction, and wherein the first resilient member generates the first restoring force which pushes the spool in a reverse direction opposite to the forward direction, and wherein the second resilient member generates the second restoring force that pushes the spool in the forward direction and is smaller than the first restoring force in the first region.

10. The variable valve timing device in claim 1, wherein one of the first region and the second region includes a region in which the vane rotor is controlled to change the rotational phase, and the other one of the first region and the second region includes a region in which the vane rotor is controlled to lock the rotational phase in a middle phase between a most advanced phase and a most retarded phase.

11. The variable valve timing device in claim 1, wherein the first resilient member and the second resilient member are disposed in the sleeve.

12. The variable valve timing device in claim 1, wherein the housing is adapted to rotate synchronously with the crankshaft, and the vane rotor is adapted to rotate synchronously with the camshaft.

* * * * *